US005911209A

United States Patent [19]

Kouda et al.

[11] Patent Number: 5,911,209

[45] Date of Patent: Jun. 15, 1999

[54] FUEL VAPOR PROCESSOR DIAGNOSTIC DEVICE

[75] Inventors: Yasuo Kouda; Kenichi Goto, both of Zama; Hideharu Kadooka, Sagamihara, all of Japan

[73] Assignee: Nissan Motor Co., Ltd., Yokohama, Japan

[21] Appl. No.: 08/964,869

[22] Filed: Nov. 5, 1997

[30] Foreign Application Priority Data

Nov. 5, 1996 [JP] Japan ..... 8-292761

[51] Int. Cl.[6] ..... F02M 37/04

[52] U.S. Cl. ..... 123/520; 123/198 D

[58] Field of Search ..... 123/198 D, 518, 123/519, 520, 521, 516

[56] References Cited

U.S. PATENT DOCUMENTS

| | | | |
|---|---|---|---|
| 5,197,442 | 3/1993 | Blumenstock | 123/198 D |
| 5,327,873 | 7/1994 | Ohuchi | 123/198 D |
| 5,345,917 | 9/1994 | Maruyama | 123/198 D |
| 5,479,905 | 1/1996 | Ito | 123/198 D |
| 5,542,397 | 8/1996 | Takahata et al. | 123/520 |
| 5,601,065 | 2/1997 | Tamura | 123/198 D |

*Primary Examiner*—Carl S. Miller
*Attorney, Agent, or Firm*—Foley & Lardner

[57] ABSTRACT

In a fuel vapor processor for use with an engine provided with a fuel tank comprising a filler tube which fits on a fuel nozzle for refueling, the presence of leaks of fuel vapor is diagnosed according to a variation of a test pressure has been introduced into a purge passage. If refueling of the fuel tank is being performed during the leak diagnosis, an escape vent for air in the fuel tank is provided by connecting the canister to the atmosphere so that smooth refueling is performed.

11 Claims, 20 Drawing Sheets

FG. 18

FUEL VAPOR PROCESSOR DIAGNOSTIC DEVICE

FIELD OF THE INVENTION

This invention relates to leak diagnosis of a fuel vapor processor of a vehicle engine.

BACKGROUND OF THE INVENTION

In order to prevent the fuel vapor which vaporizes in a fuel tank of a vehicle engine from being discharged to the atmosphere, the fuel vapor is led to a canister together with air through a vapor passage connecting the fuel tank and the canister, active carbon in the canister absorbs only fuel particles, and the remaining air is discharged from an atmospheric connection port of the canister.

When predetermined running conditions are met, a purge cut valve provided in a purge passage is opened, the absorbed fuel separates from the active carbon due to fresh air entering the canister from the aforesaid atmospheric connection port as a result of the engine intake negative pressure, mixes with the intake air, and is burnt.

Such a system is known as a fuel vapor purge system.

However, when there is a leak hole from the fuel tank to the engine intake and there is a defect in pipe join seals, fuel escapes to the atmosphere. In this regard, OBDII, which has been an obligatory fault diagnostic function for all U.S. made vehicles since 1994, specifies that if there is a leak hole of 1 mm diameter or more in the passage from the fuel tank to the purge cut valve, a warning lamp must light. In this case, the existence of a leak may be detected by monitoring pressure fluctuations in the fuel vapor flowpath when the flowpath is a closed space having a difference from atmospheric pressure.

U.S. Pat No. 5,542,397 discloses a method where a positive pressure is first introduced into the flowpath to perform leak diagnosis, and when a positive pressure cannot be obtained, the negative intake pressure of the engine is introduced into the flowpath to perform leak diagnosis.

In both cases, the flowpath must be sealed during the diagnosis, and an air conducting valve installed in the atmospheric connection port of the canister is therefore closed.

In such a leak diagnostic device, it may occur that refueling is performed while a diagnosis is being made. To perform refueling, a fuel nozzle is generally inserted in a filler tube connected to the fuel tank. The filler tube is so constructed that the fuel nozzle is in intimate contact with its inner circumference, so that fuel vapor does not escape from the filler tube to the outside. In this case, air from the fuel tank is discharged from the atmospheric connection port of the canister as refueling progresses.

However, if fuel is supplied when the air conducting valve is closed, there is no path from which the air in the fuel tank can escape, hence even when fuel flows in from the filler tube, it does not enter the fuel tank due to the pressure rise in the tank. Such a situation may occur for example when leak diagnosis is started while the vehicle is running, the vehicle is stopped and refueling is performed without stopping the engine while the diagnosis is being performed.

SUMMARY OF THE INVENTION

It is therefore an object of this invention to ensure an escape route for air in the fuel tank when refueling is being performed during leak diagnosis, and hence to permit refueling to be carried out smoothly.

In order to achieve the above object, this invention provides a leak diagnostic device for use with a fuel vapor processor of an engine of a vehicle. The engine comprises a fuel tank, and the processor comprises a canister for temporarily collecting fuel vapor in the fuel tank, an air conducting valve for connecting the canister to the atmosphere, a vapor passage connecting the fuel tank and the canister, a vapor passage valve for opening and closing the vapor passage, a purge passage connecting the canister and an engine intake passage, and a purge passage valve for opening and closing the purge passage. The leak diagnostic device comprises a sensor for detecting a pressure in a space comprising any one of the vapor passage, the canister, the purge passage and the fuel tank, and a controller functioning to introduce a test pressure different from atmospheric pressure to the space by controlling any one of the air conducting valve, vapor passage valve and purge passage valve, perform a leak diagnosis of the space based on a pressure variation in the space after introducing the test pressure, determine if refueling of the fuel tank is being performed, and control the air conducting valve so that the canister is connected to the atmosphere when refueling is performed during the leak diagnosis.

It is preferable that the controller is further functioning to stop the leak diagnosis if refueling of the fuel tank is being performed.

It is also preferable that the controller is further functioning to determine that refueling of the fuel tank is being performed when a pressure in the space has increased above a predetermined increase factor.

If the fuel tank is provided with a filler tube for refueling and a filler cap for sealing the filler tube, it is also preferable that the device further comprises a sensor for detecting that the filler cap has been removed, and the control unit is further functioning to determine that refueling of the fuel tank is being performed when the filler cap has been removed.

The controller may introduce a positive pressure in the fuel tank into the space as a test pressure by opening the vapor passage valve.

The controller may introduce an intake negative pressure of the engine into the space as a test pressure by opening the purge passage valve.

It is also preferable that the controller is further functioning to detect an abnormal low pressure state wherein a large negative pressure exceeding a predetermined level continues to exist for a predetermined time, and when refueling is performed during leak diagnosis after the abnormal low pressure state is detected, open the purge passage valve.

In this case, it is further preferable that the controller is further functioning to detect an engine stop, and when refueling is performed in an engine stop state after the abnormal low pressure state is detected, open the purge passage valve.

This invention also provides a leak diagnostic device for use with a fuel vapor processor of an engine of a vehicle, wherein the engine is provided with a fuel tank provided with a filler tube for refueling and a filler cap which seals the filler tube. The device comprises a first sensor for detecting a pressure in a space comprising any one of the vapor passage, the canister, the purge passage and the fuel tank, a passage for conducting air in the fuel tank to the canister when refueling of the fuel tank is performed via the filler tube, a controller functioning to introduce a test pressure different from atmospheric pressure to the space by controlling any one of the air conducting valve, vapor passage valve and purge passage valve, and perform a leak diagnosis of the space based on a pressure variation in the space after introducing the test pressure, a second sensor for detecting if the filler cap has been removed, and an electrical circuit configured to forcibly open the air conducting valve when the filler cap has been removed.

It is preferable that the air conducting valve comprises a valve which closes due to electrical energization, the second sensor comprises a switch which switches ON when the filler cap is set on the filler tube, and switches OFF when the filler cap is removed from the filler tube, and the electrical circuit comprises a power transistor interposed in the current path from a power supply to the air conducting valve and a circuit connecting a base of the power transistor to the power supply via the switch.

This invention also provides a leak diagnostic device comprising a mechanism for detecting a pressure in a space comprising any one of the vapor passage, the canister, the purge passage and the fuel tank, a mechanism for introducing a test passage different from atmospheric pressure to the space by controlling any one of the air conducting valve, vapor passage valve and purge passage valve, a mechanism for performing a leak diagnosis of the space based on a pressure variation in the space after introducing the test pressure, a mechanism for determining if refueling of the fuel tank is being performed, and a mechanism for controlling the air conducting valve so that the canister is connected to the atmosphere when refueling is performed during the leak diagnosis.

The details as well as other features and advantages of this invention are set forth in the remainder of the specification and are shown in the accompanying drawings.

DESCRIPTION OF THE PREFERRED EMBODIMENTS

Figure 1:
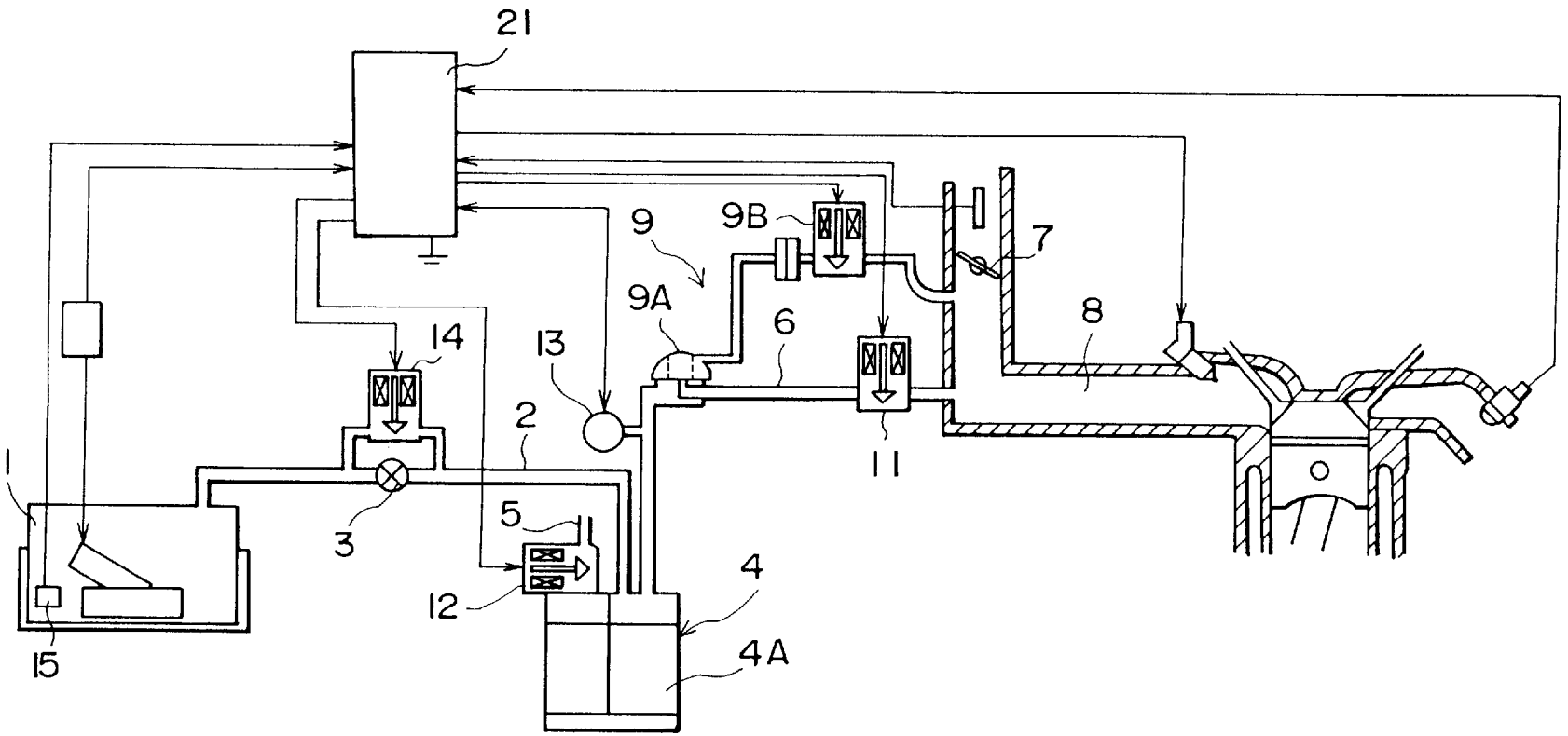
FIG. 1 is a schematic diagram of a leak diagnostic device according to this invention.

Referring to FIG. 1 of the drawings, fuel vapor produced in a fuel tank 1 is led to a canister 4 through a vapor passage 2, and is adsorbed by active carbon 4A in the canister 4.

A pressure control valve 3 is provided in the vapor passage 2.

Figure 2:
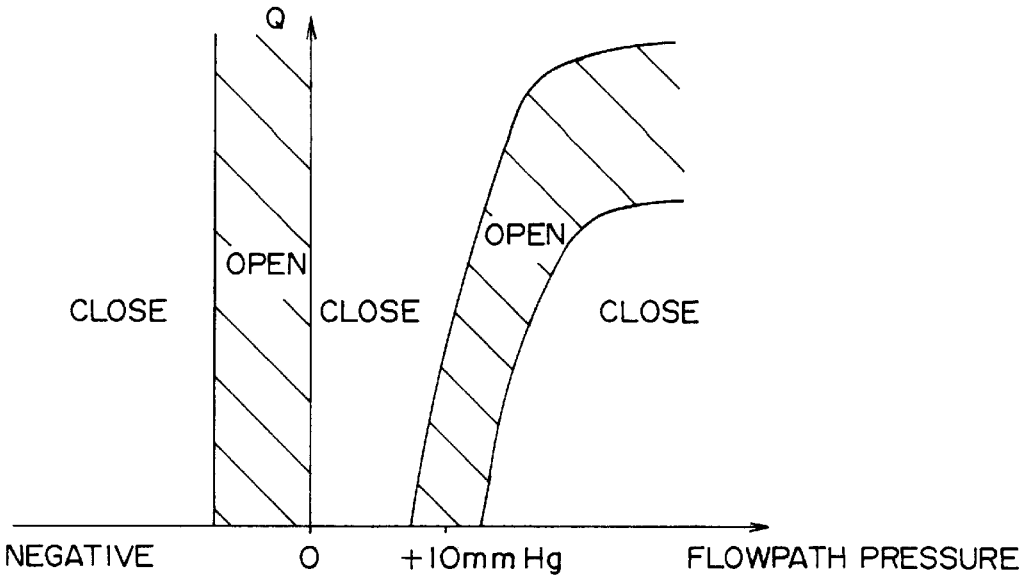
FIG. 2 is a graph showing flowrate characteristics of a vacuum cut valve used in a leak diagnostic device.

The pressure control valve 3 is a valve having a mechanical construction such that the valve opens when the fuel tank 1 is at a lower pressure than atmospheric or has reached a pressure of approximately +10 mmHg above atmospheric as shown in FIG. 2.

In FIG. 2, atmospheric pressure, i.e. 0 mmHg, is taken as standard, pressures above atmospheric being denoted by [+] and pressures lower than atmospheric being denoted by [−].

In the following description, all pressures will be denoted in this way. The canister 4 connects with an intake pipe 8 of an engine downstream of an intake throttle 7 through a purge passage 6.

A purge cut valve 9 which is normally closed, comprising a diaphragm actuator 9A and a solenoid valve 9B, is provided in the purge passage 6.

When the solenoid valve 9B is in the OFF state, a diaphragm which is pushed downward in FIG. 2 by a return spring of diaphragm actuator 9A closes the purge passage 6.

When the solenoid valve 9B turns ON, intake negative pressure is introduced into a negative pressure working chamber of the diaphragm actuator 9A the diaphragm moves to the upper part of the figure against the return spring due to this negative pressure, and the purge passage 6 is opened.

The solenoid valve 9B turns ON and OFF due to a signal from a control unit 21.

A purge control valve 11 which is driven by a step motor is provided in the purge passage 6 in series with the purge cut valve 9. The purge control valve 11 is opened and closed by a signal from the control unit 21. For example, when the purge valve 11 is opened such as in the low engine load area after engine warm up, fresh air is led into the canister 4 from an atmospheric connection port 5 provided in the canister 4 due to intake negative pressure developing downstream of the throttle. Fuel vapor adsorbed by the activated carbon 4A leaves the activated carbon 4A due to this flow of fresh air, enters the inlet pipe 8 together with the fresh air, and is burnt in the combustion chamber.

During purge, the purge cut valve 9 is open.

The reason for providing the two valves 9, 11 in the purge passage 6 is that even if the purge control valve 11 has broken down and remains open, the purge cut valve 9 which is normally closed can prevent purge gas from being introduced into the inlet pipe 8 under conditions except under purge conditions. The purge control valve 11 functions as a variable orifice during leak diagnosis using a negative pressure, described hereafter. The purge cut valve 9 and purge control valve 11 correspond (i.e., each or together) to a purge passage valve.

An air conducting valve 12 which is normally open so as to connect the canister 4 to the atmosphere is provided in the fresh air inlet path 5. The air conducting valve 12 is closed by a signal from the control unit 21 in order to seal the space between the purge cut valve 9 and fuel tank 1 during leak diagnosis.

Figure 3:
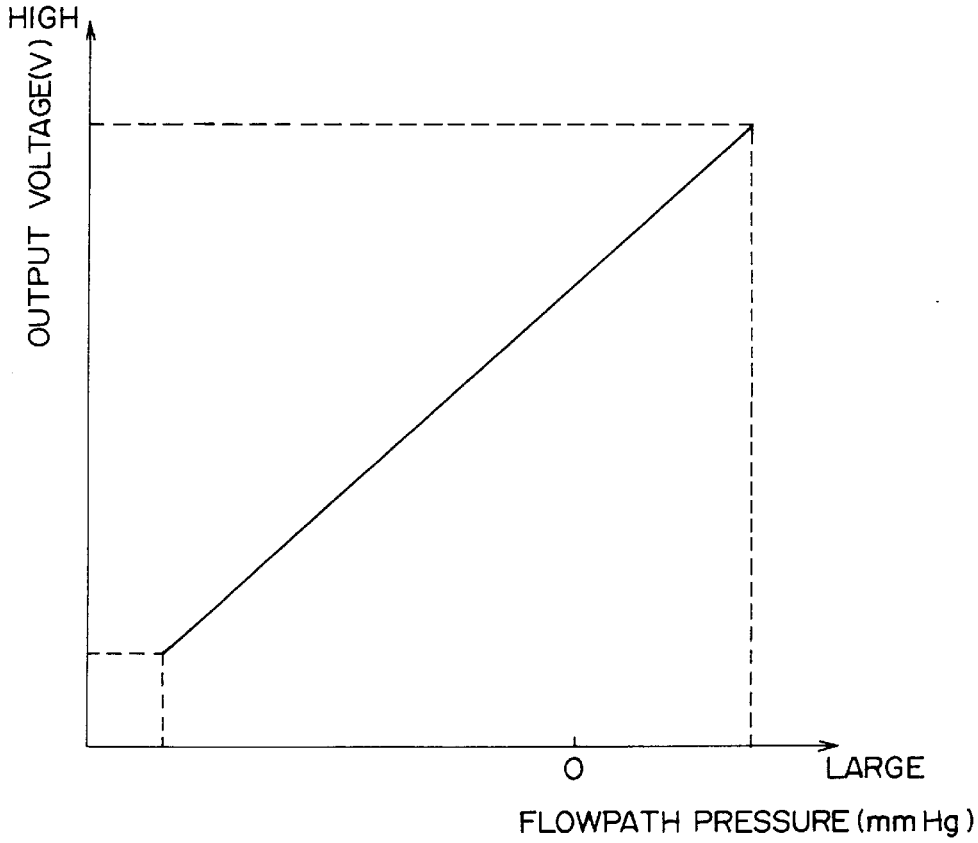
FIG. 3 is a graph showing output characteristics of a pressure sensor used in the leak diagnostic device.

A pressure sensor 13 is provided in the purge passage 6 between the canister 4 and purge cut valve 9. The pressure sensor 13 outputs a voltage in proportion to the pressure (relative pressure based on atmospheric pressure) of the flowpath which is sealed during leak diagnosis. The output characteristics of the pressure sensor 13 are is shown in FIG. 3.

A fuel temperature sensor 15 is provided in the fuel tank 1.

A bypass valve 14 which is normally closed is provided in the vapor passage 2 in parallel to the pressure control valve 3.

The bypass valve 14 connects the fuel tank 1 and canister 4 in order to introduce the positive pressure of the fuel tank 1 (of the order of +10 mmHg) into the canister 4 when the vacuum cut valve 3 is closed, and introduce the negative pressure of the canister 4 into the fuel tank 1. The bypass valve 14 opens and closes due to a signal from the control unit 21. The pressure control valve 3 and bypass valve 14 correspond (i.e., each or together) to a vapor passage valve.

The control unit 21, which comprises a microcomputer, determines whether or not there is a leak while the engine is running by opening and closing the purge cut valve 9, purge control valve 11, air conducting valve 12 and bypass valve 14. This diagnosis is performed at a frequency of approximately once in one vehicle run.

Leak diagnosis is first performed using fuel vapor pressure (positive pressure) generated as a result of rise of fuel temperature due to running the engine, and when the necessary positive pressure cannot be obtained, it is performed using intake negative pressure.

First, an outline of leak diagnosis will be described, and a more detailed description given thereafter.

<1> Outline of leak diagnosis using positive pressure

Normally, a part of the fuel in the fuel tank 1 vaporizes due to rise of temperature after engine startup. As the vacuum cut valve 3 can maintain a positive pressure of about +10 mmHg in the fuel tank 1, the fuel tank 1 will be under a positive pressure when fuel vapor is produced if there is no leak in the fuel tank 1.

The leak diagnosis procedure using this positive pressure will be described referring to FIGS. 4A–4E.

(i) When it has been supposed that the pressure in the fuel tank 1 is high enough for the diagnosis, the purge cut valve 9 and purge control valve 11 are temporarily closed, and purge is stopped. When the purge cut valve 9 and purge control valve 11 are closed, intake negative pressure no longer acts on the purge passage 6 and canister 4. At the same time, air is introduced into the purge passage 6 from the air conducting valve 12 so that the flowpath pressure is restored to atmospheric pressure.

(ii) Several seconds after the valves 9 and 10 are closed, the air conducting valve 12 is closed.

(iii) One second after closing the air conducting valve 12, the bypass valve 14 is opened so as to connect the fuel tank 1 and canister 4, and the positive pressure P in the flowpath is detected by the pressure sensor 13.

(iv) If the flowpath pressure P does not rise higher than a predetermined value $p_1$, (pressure satisfying the relation $p_1$<+10 mmHg), it may be assumed that there is a leak in the fuel tank 1 or that fuel vapor has not been produced in the fuel tank 1.

In this case, leak diagnosis is performed using intake negative pressure as described here below.

(v) If on the other hand the flowpath pressure P rises above the predetermined value $p_1$, the flowpath pressure is sampled as the first pressure $DP_1$. This means that a positive pressure higher than the predetermined value $p_1$, was being maintained in the fuel tank 1, and therefore it is determined that there is no leak in the fuel tank 1.

(vi) The bypass valve 14 is then closed, the flowpath pressure at a predetermined time $t_2$ (e.g. 6 seconds) after closing the bypass valve 14 is sampled as a second pressure $DP_2$, and a leak parameter $AL_1$ is calculated by the following expression:

$$AL_1[\text{mmHg}]=DP_1-DP_2 \quad (1)$$

(vii) The leak parameter $AL_1$, and a reference value $c_1$, [mmHg]are compared, and it is determined whether or not to switch on a warning lamp.

Figures 4A, 4B, 4C, 4D, 4E:
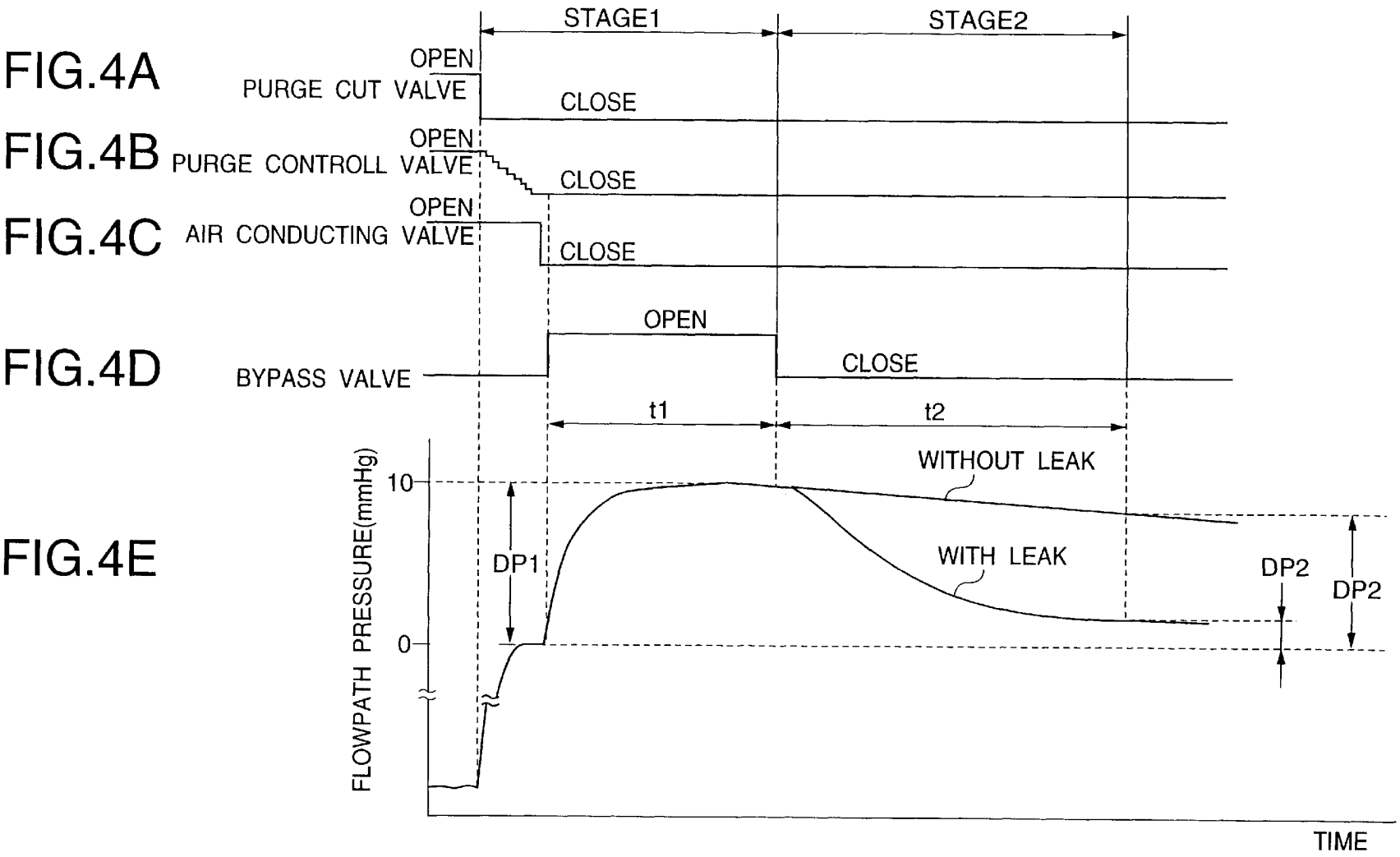
FIGS. 4A–4E are diagrams showing a pressure change during leak diagnosis using positive pressure according to the leak diagnostic device.
Figures 5A, 5B, 5C, 5D, 5E:
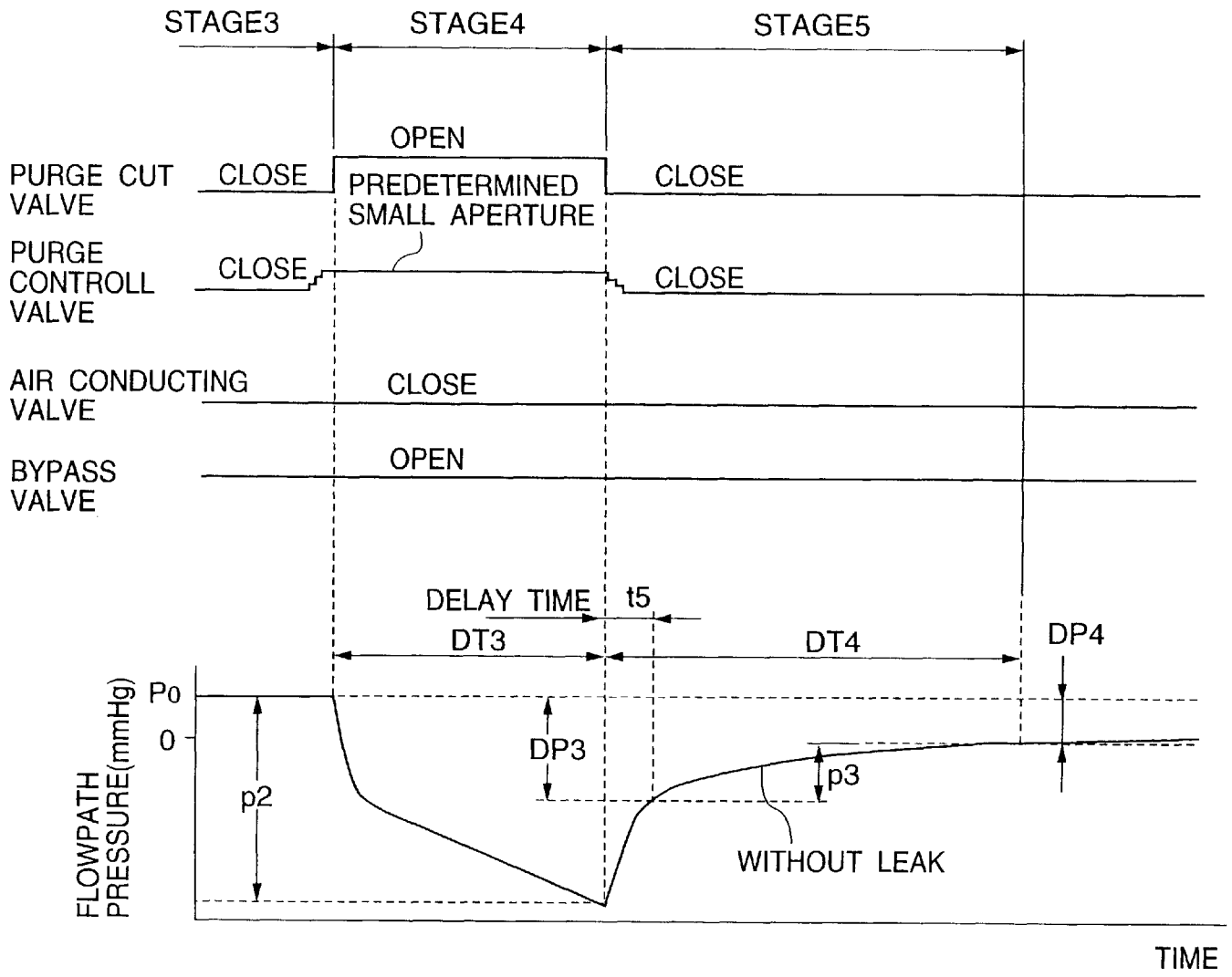
FIGS. 5A–5E are diagrams showing a pressure change when there is no leak during leak diagnosis using negative pressure according to the leak diagnostic device.
Figures 6A, 6B, 6C, 6D, 6E:
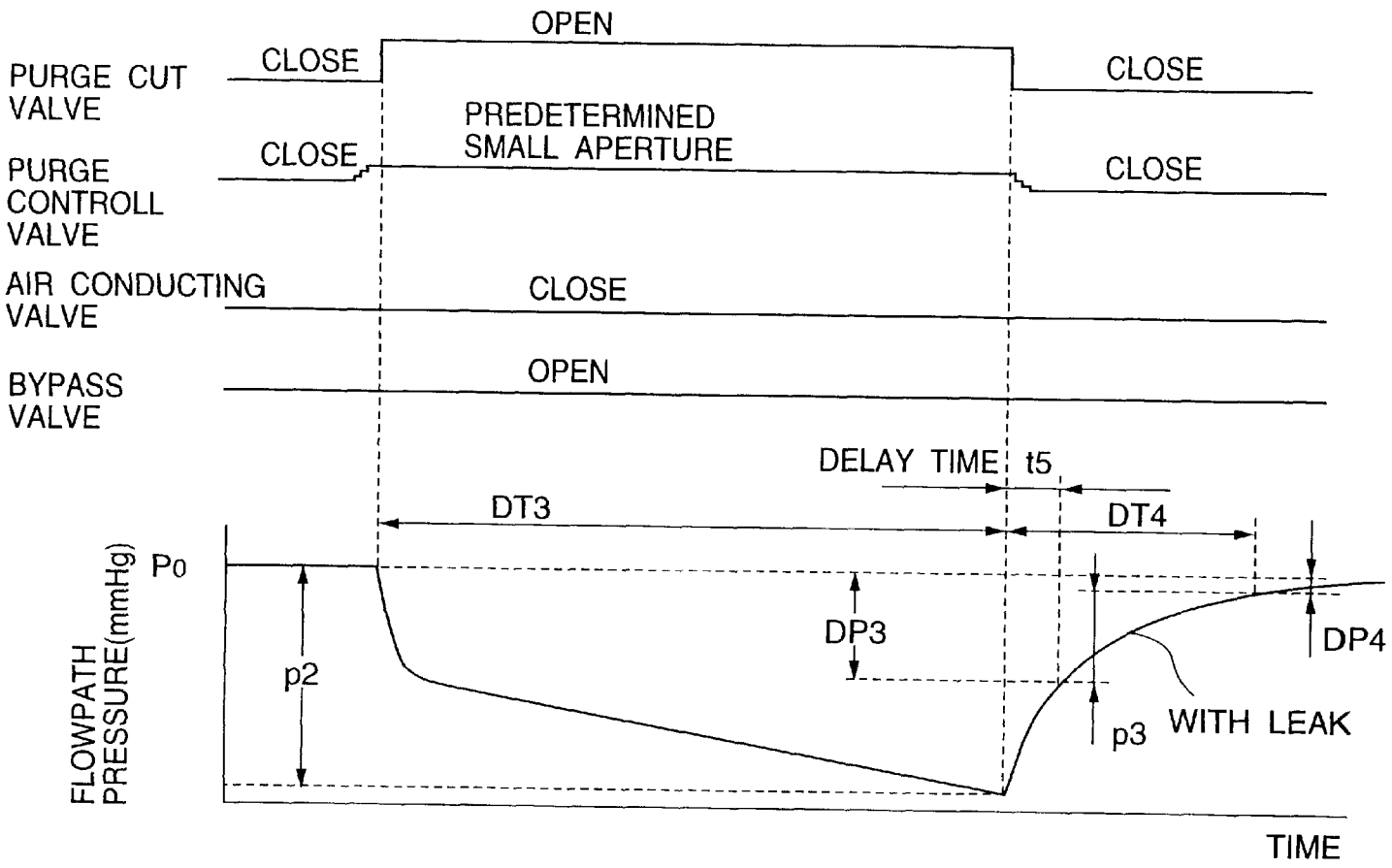
FIGS. 6A–6E are similar to FIGS. 5A–5E, but showing a pressure change when there is a leak.

As shown in FIG. 4E, when there is a leak, the value of $DP_2$ is small and the value of $AL_1$ is large. When there is no leak, the value of $DP_2$ is large, and the value of $AL_1$ is small. Therefore, it is determined that when $AL_1 \geqq c_1$ there is a leak, and when $AL_1 < c_1$ there is no leak. The reference value $c_1$ is set as follows.

Specifically, a leak hole having a predetermined opening area is provided, the value of $AL_1$ is found experimentally, and $c_1$ is set between this value and the value of $AL_1$ when there is no leak. When $AL_1$ is greater than the predetermined value $c_1$, the control unit 21 sets a diagnosis code to a value indicating a leak, and this diagnosis code is stored even after the engine has stopped.

<2> Outline of leak diagnosis using intake negative pressure

The leak diagnosis procedure using negative pressure will be described referring to FIGS. 5A–5E and FIGS. 6A–6E.

FIGS. 5A–5E show waveforms for the case when there is no leak, and FIGS. 6A–6E show waveforms for the case when there is a leak.

(i) When for example, the intake negative pressure is less than −300 mmHg it is determined that conditions for performing diagnosis are satisfied. The purge cut valve 9 is closed, purge is temporarily stopped, the bypass valve 14 is opened and the air conducting valve 12 is closed so as to seal the flowpath from the fuel tank 1 to the purge cut valve 9.

(ii) The purge control valve 11 is set to a small predetermined opening of for example several liters a minute compared with the maximum opening during purging.

The flowpath pressure P at this moment is stored as an initial pressure $P_0$.

(iii) The purge cut valve 9 is opened, and the pressure in the flowpath from the fuel tank 1 to the purge cut valve 9 is reduced to a negative pressure.

(iv) When a differential pressure $P_0-P$ between the initial pressure $P_0$ and the flowpath pressure P reaches a predetermined value $p_2$, an elapsed time from starting pressure reduction is sampled as a pull-down time $DT_3$ [sec], and the purge cut valve 9 is closed.

When a time $t_4$ (set to approximately several minutes) has elapsed after starting pressure reduction without $P_0-P$ reaching $p_2$, that value is sampled as $DT_3$.

An intake negative pressure must be equal to or greater than a predetermined value throughout pressure reduction.

$p_2$ is set to +several 10 mmHg such that its value is far smaller than the absolute value of the intake negative pressure.

(v) $P_0-P$ at a delay time $t_5$ (for example several seconds) that is necessary for gas to stop flowing and pressure loss to cease after closing the purge cut valve 9, is sampled as a pull-down pressure $DP_3$ [mmHg].

$DP_3$ represents the actual result of pressure reduction.

(vi) After $DP_3$ has become equal to or greater than a predetermined value $p_3$ (e.g. +several mmHg), $P_0-P$ at that time is sampled as a recovery pressure $DP_4$ [mmHg].

Also, the time from when the purge cut valve 9 is closed to when the recovery pressure $DP_4$ is sampled, is sampled as a recovery time $DT_4$ [sec]. When the predetermined time $t_4$ elapses without $P-DP_3$ reaching the predetermined value $p_3$, $P_0-P$ at that time is sampled as $DP_4$ and $t_4$ is sampled as $DT_4$.

(vii) A leak hole area $AL_2$ [mm2] is calculated by the following expression from the sampled pressures $DP_3$, $DP_4$ and times $DT_3$, $DT_4$.

$$AL_2 = K \cdot A' \tag{2}$$

$$A' = C \cdot \left(\frac{DT_3}{DT_4}\right) \cdot Ac \cdot \frac{\left(\sqrt{DP_3} - \sqrt{DP_4}\right)}{DP_3} \tag{3}$$

where,

Ac=orifice area [mm2] of purge control valve during pressure reduction

C=correction coefficient for adjusting units (e.g. 26.6957)

K=correction coefficient (viii) A reference value $c_2$ is compared with the leak hole area $AL_2$, and it is determined whether or not to switch on the warning lamp.

A leak hole having a predetermined opening area is provided beforehand, the value of $AL_2$ is found experimentally, and $c_2$ is set between this value and the value of $AL_1$, when there is no leak. When $AL_2$ is greater than the determined value $c_2$, the control unit 21 sets a diagnosis code to a value indicating a leak, and this diagnosis code is stored even after the engine has stopped.

(ix) If the aforesaid diagnosis condition (i) has not been satisfied for the predetermined time $t_3$ (e.g. several seconds) or longer due to continuous acceleration and deceleration of the vehicle, the diagnosis (1) using positive pressure is repeated.

The aforesaid leak diagnosis is known from U.S. Pat. No. 5,542,397.

Next, the sequence of diagnostic processes performed by the control unit 21 will be described with reference to the flowchart of FIGS. 7A–7D.

In this flowchart, steps S81–S85 and steps S91–S94 are parts illustrating the characteristic features of this diagnostic device.

The construction of the aforesaid art example will first be described, followed by a description of steps which are unique to this diagnostic device.

First in a step S1, it is determined whether or not leak diagnosis start conditions hold, and when these conditions hold, the routine proceeds to a step S2. Examples of leak diagnosis start conditions are that the pressure sensor 13 is working normally and that specific valves such as the drain cut valve 12 and bypass valve 14 have no defects.

In the step S2, a leak diagnosis experience flag is looked up. If leak diagnosis has not yet been performed during this running of the vehicle, the leak diagnosis experience flag=0. In this case, a positive pressure diagnosis condition flag which shows whether or not the conditions hold for performing leak diagnosis using positive pressure is determined in a step S3.

If the positive pressure diagnosis condition flag is "1", the routine proceeds to leak diagnosis in a step S4 and subsequent steps.

Figure 8:
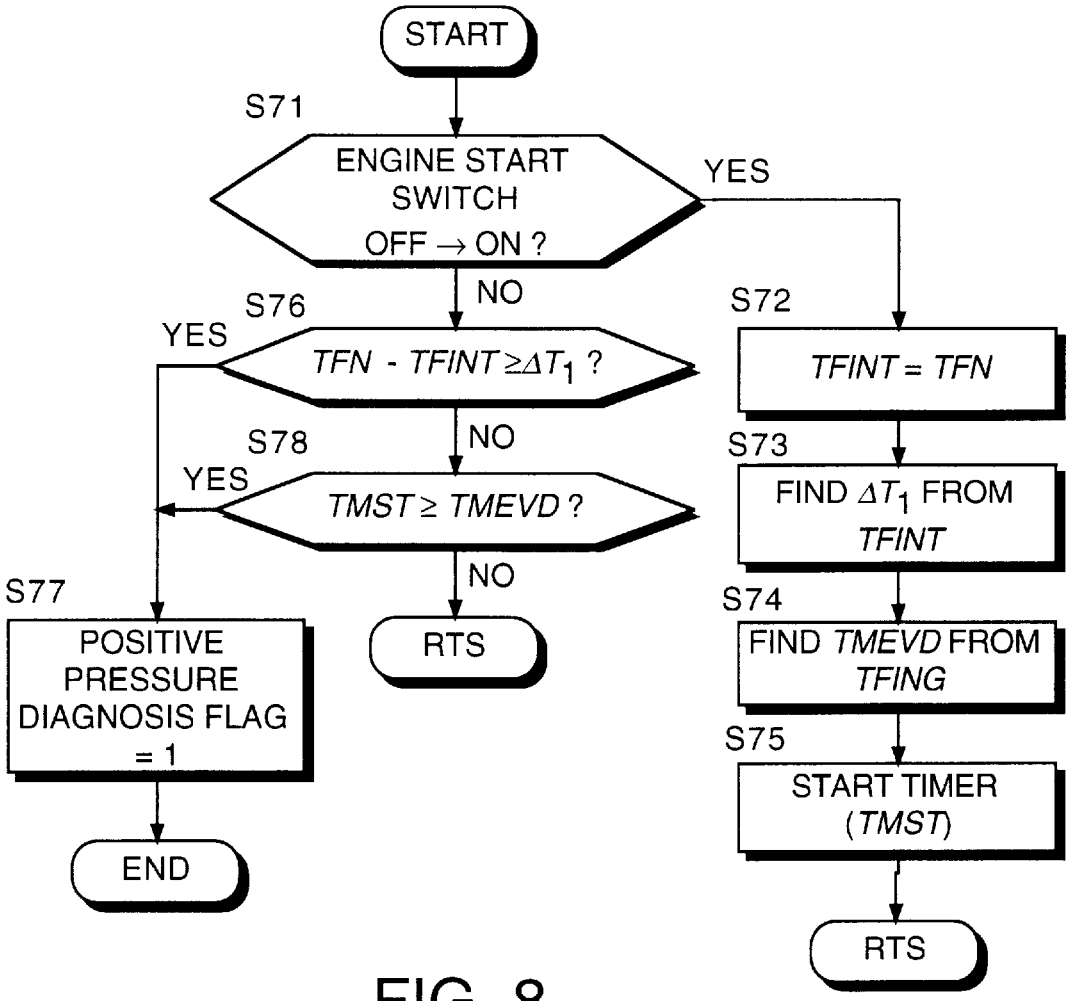
FIG. 8 is a flowchart describing a determining process under positive pressure diagnosis conditions performed by the diagnostic device.

The positive pressure diagnosis condition flag is set by a process in FIG. 8 described hereafter. These flags are all initialized to "0" together with other flags mentioned later.

The routine from step S4 to S9 corresponds to Stage 1 shown in FIGS. 4A–4E.

According to this process, leak diagnosis is sorted by five stages as shown in FIGS. 4A–4E and FIGS. 5A–5E.

A stage 1 flag is looked up in the step S4. If leak diagnosis is not performed, the Stage 1 flag is "0". In this case, the purge cut valve 9, purge control valve 11 and air conducting valve 12 are closed in a step S5, and the bypass valve 14 is opened.

First, the purge cut valve 9 is closed and purge is stopped, then the purge control valve 11 and air conducting valve 12 are closed, and the bypass valve 14 is opened, as shown in FIGS. 4A–4E.

In a step S6, it is determined whether or not a predetermined time $t_1$ has elapsed from when the bypass valve 14 is opened. $t_1$ is set to, for example, several seconds.

When the time $t_1$ has elapsed, a flowpath pressure P at that time is compared with a predetermined value $p_1$ in a step S7. When $P \geqq p_1$, the flowpath pressure P is transposed to a parameter $DP_1$ in a step S8, it is determined that there is no leak in the fuel tank, and "1" is entered in the stage 1 flag in a step S9. The predetermined value $p_1$ is set to, for example, +several mmHg.

When $P<p_1$, the leak cannot be stopped using positive pressure, so the routine shifts to performing leak diagnosis using negative pressure.

Figure 7A:
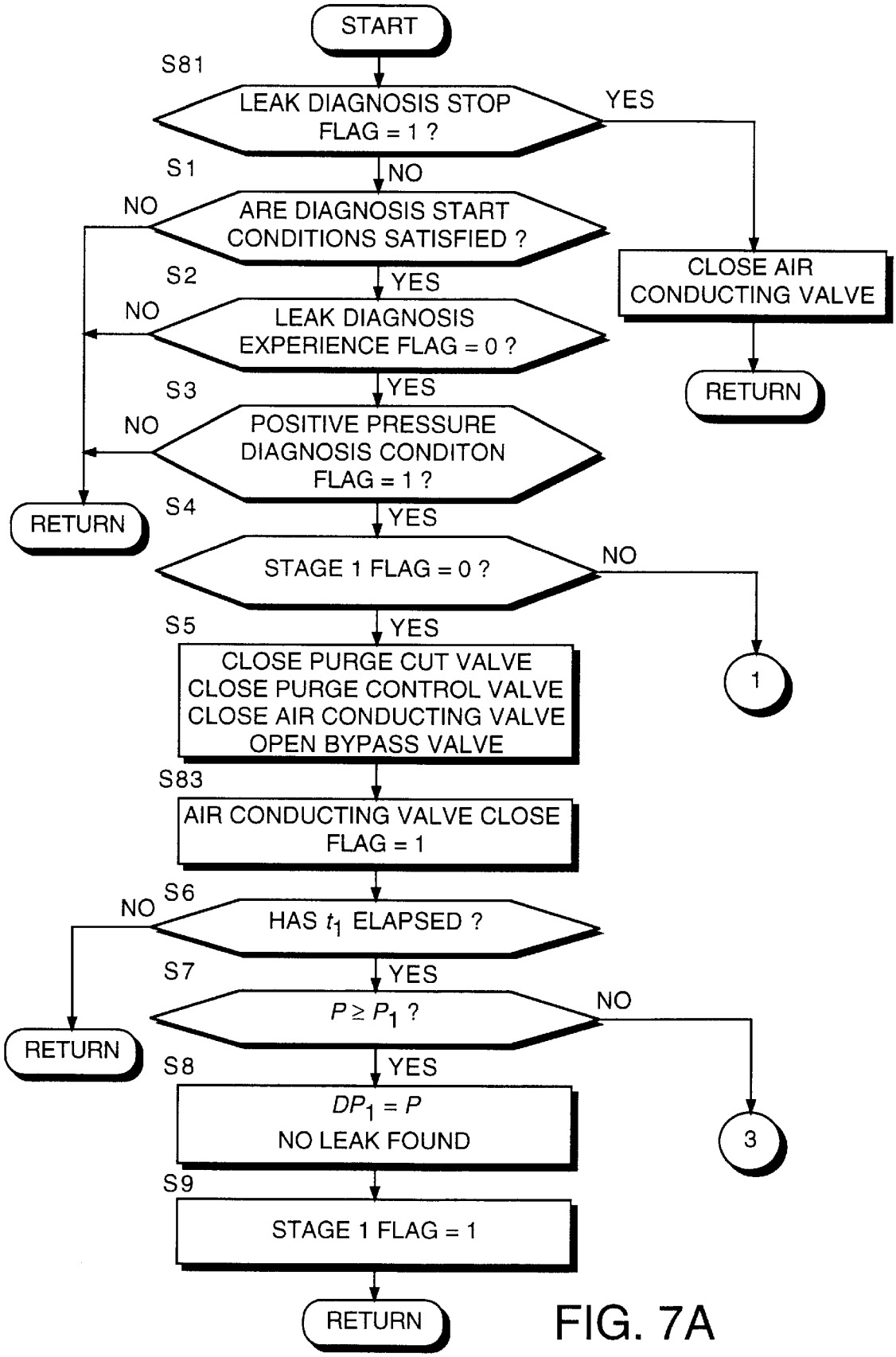
FIGS. 7A–7D are flowcharts describing a leak diagnosis process performed by the diagnostic device.
Figure 7B:
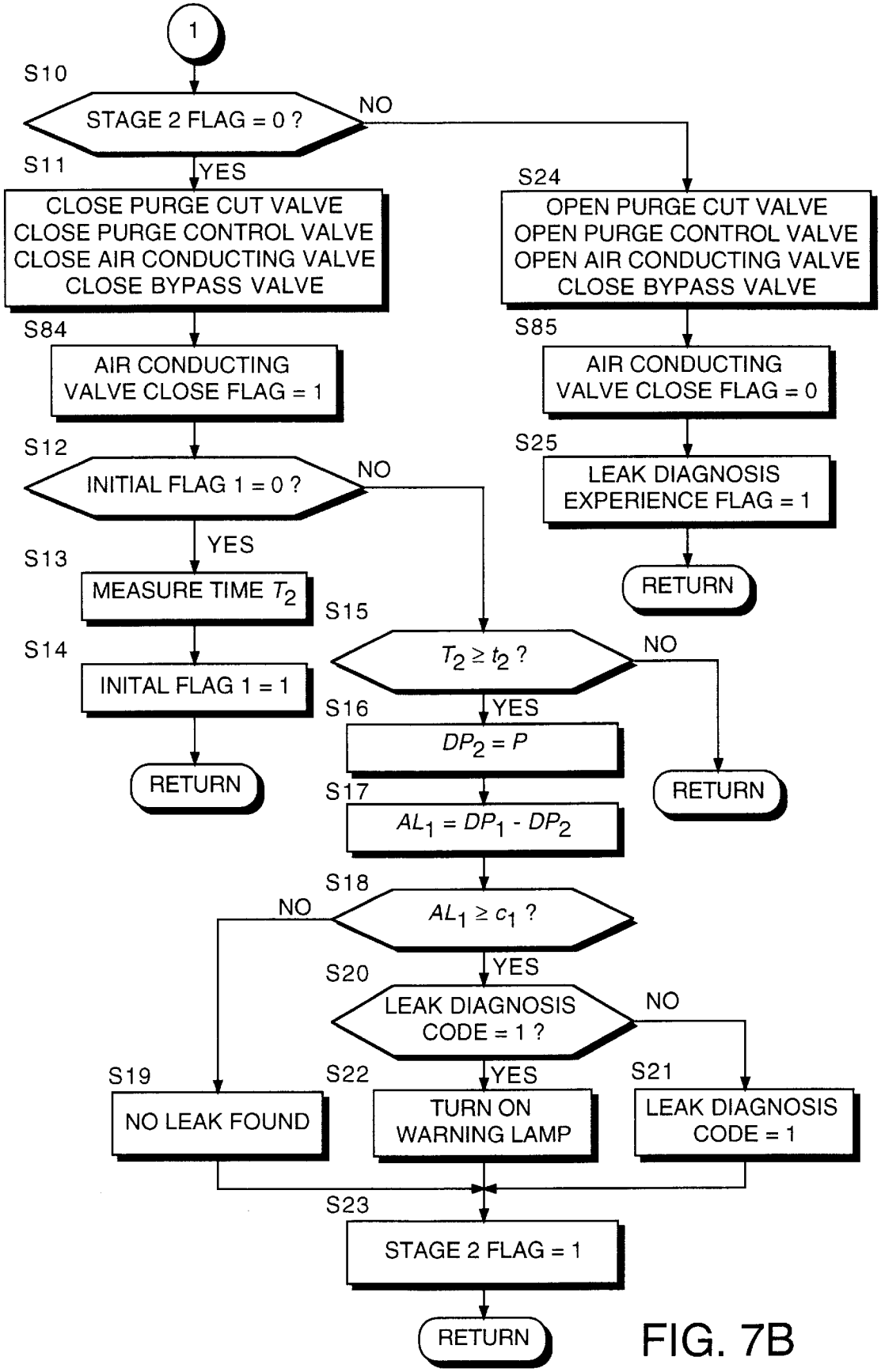

By setting the stage 1 flag to "1" in the step S9, the process proceeds to the steps of FIG. 7B from the step S4 on the next occasion.

In a step S10 of FIG. 7B, it is determined whether or not a stage 2 flag is "0". When the stage 2 flag is "0", the routine proceeds to a step S11, and the purge cut valve 9, purge control valve 11, air conducting valve 12 and bypass valve 14 are closed.

In a step S12, it is determined whether or not an initial flag 1 "0". Before performing leak diagnosis, the initial flag 1, an initial flag 2 and an initial flag 3 described hereafter, are "0". The process therefore proceeds to a step S13.

At this point, a timer is started to measure a time $T_2$,

"1" is entered in the initial flag 1 in a step S14, and this control process is terminated. The timer value $T_2$ measures the elapsed time from when the bypass valve 14 is closed. By setting the initial flag 1 to "1", the process proceeds from a step S15 from the step S12 on the next occasion.

In the step S15, the timer value $T_2$ is compared with a predetermined time $t_2$. Before $t_2$ reaches $T_2$, this control process is terminated. $t_2$ is set to, for example, 6 seconds. Eventually $T_2 \geqq t_2$, and the routine proceeds to a step S16. At this point, the flowpath pressure P is entered in a parameter $DP_2$.

In a step S17, a leak parameter $AL_1$ is calculated by the above expression (1). In a step S18, the predetermined value $c_1$ is compared with this parameter $AL_1$, and when $AL_1<c_1$, it is determined that there is no leak in a step S19. When $AL_1 \geqq c_1$, the routine proceeds to a step S20, and a leak diagnosis code is determined.

The leak diagnosis code is stored in a backup RAM in the control unit 21 which indicates whether or not it was determined that there was a leak on the immediately preceding occasion when the vehicle was run. When the leak diagnosis code is "0", it signifies that a leak has been determined for the first time. In this case, the leak diagnosis code is set to "1" in a step S21, and this is stored in the backup RAM.

When the leak diagnosis code is "1", the routine proceeds to a step S22, and a warning lamp lights up on the dashboard in the passenger compartment.

In a step S23, "1" is entered in the stage 2 flag and this control process is terminated. By setting the stage 2 flag to "1", the process proceeds to a step S24 from the step S10 on the next occasion.

At this point, the purge cut valve 9, purge control valve 11 and air conducting valve 12 are opened and the bypass valve 14 is closed in order to stop purging.

Subsequently, the leak diagnosis experience flag is set to "1" in a step S25 and diagnosis is terminated so that leak diagnosis is not performed until the engine stops and restarts.

When the leak diagnosis experience flag is "1", the process cannot proceed from the step S2 to the step S3 of FIG. 7A on the next occasion. In other words, this leak diagnosis experience flag ensures that leak diagnosis is performed only once each time the vehicle runs.

Figure 7C:
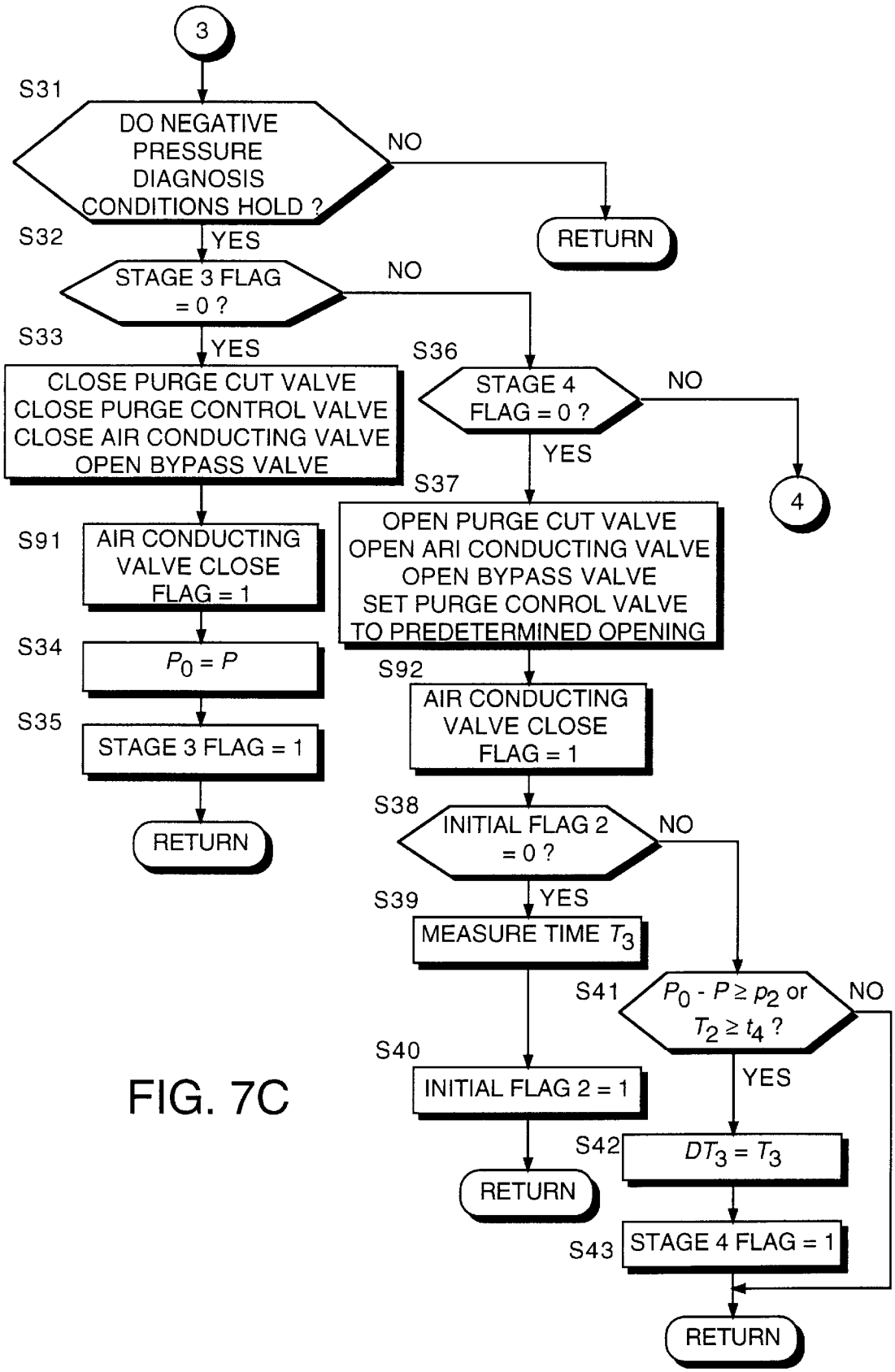

When $P<p_1$ in the step S7 of FIG. 7A, the process proceeds to a step S31 of FIG. 7C. In the step S31, it is determined whether or not the conditions hold for performing leak diagnosis using negative pressure. For example, for a vehicle with a manual transmission, negative pressure diagnosis conditions obtain when the vehicle is in 4th or 5th gear, and the intake negative pressure is approximately −300 mmHg.

When these conditions do not obtain, the process is terminated.

Although not shown in the flowcharts, an elapsed time from when the step S31 is reached for the first time may be measured and compared to a time $t_3$, and when negative pressure diagnosis conditions do not obtain even after the time $t_3$ has elapsed, the bypass valve 14 may be closed, and the diagnosis may be repeated from the start of FIG. 7A.

In this case the routine does not wait indefinitely for negative pressure diagnosis conditions to be satisfied, and as a result, leak diagnosis time is shortened by limiting time the condition determining time. The time $t_3$ may be set to, for example, several minutes.

When negative pressure diagnosis conditions hold in the step S31, it is determined whether or not a stage 3 flag is "0" in a step S32. When the stage 3 flag=0, the routine proceeds to a step S33, the purge cut valve 9, purge control valve 11, air conducting valve 12 are closed, and the bypass valve 14 is opened.

If purge was already being performed, purge is stopped by closing the purge cut valve 9.

In a step S34, the flowpath pressure P at that time is entered in a parameter $P_0$ (representing the initial pressure) so that the flowpath pressure immediately before starting negative pressure introduction can be sampled.

In a step S35, the stage 3 flag is set to "1".

The reason why the flowpath pressure immediately before negative pressure introduction is entered in the parameter $P_0$, is in order that the computational precision of the leak hole area $AL_2$ is not affected even when the flowpath pressure immediately before introducing negative pressure is different on each diagnosis.

By setting the stage 3 flag to "1", the next process proceeds from the step S32 to a step S36.

In the step S36, it is determined whether or not a stage 4 flag is "0". When the stage 4 flag=0, the routine proceeds to a step S37.

In the step S37, the air conducting valve 12 is closed, the bypass valve 14 is opened, and the flowpath from the fuel tank 1 to the purge cut valve 9 is sealed. Also, the purge control valve 11 is set to a small predetermined opening such that the flowrate is, for example, approximately several liters/min.

The operations of the valves take place in the sequence described above.

When the purge control valve 11 is opened to the above opening, gas is aspirated into the inlet pipe 8 from the purge passage 6 at a predetermined flowrate via the purge control valve 11 acting as an orifice due to the negative intake pressure, and the pressure in the flowpath extending from the fuel tank 1 to the purge control valve 11 gradually falls.

In this diagnostic device, when a positive pressure less than the predetermined value $p_1$ remains in the fuel tank 1, the diagnosis is immediately performed using negative pressure. Theoretically, when leak diagnosis is performed using negative pressure, the negative pressure is introduced after first restoring the flowpath pressure to atmospheric pressure. However, when an operation is performed to restore the flowpath pressure to atmospheric pressure, several more seconds are required. If the running conditions of the engine deviate from the negative pressure diagnosis area during this waiting time, leak diagnosis cannot be performed. Therefore, negative pressure is introduced rapidly in order to start leak diagnosis as soon as possible without first returning to atmospheric pressure.

When the initial flag 2=0 in the step S38, a timer is started to measure a time $T_3$ in a step S39. The time $T_3$ corresponds the elapsed time since the purge cut valve 9 was opened.

In a step S40, the initial flag 2 is set to "1", and this process is terminated. By setting the initial flag 2 to "1", the process proceeds from the step S38 to a step S41 on the next occasion.

At this point, a differential pressure $P_0-P$ between the initial pressure $P_0$ and flowpath pressure P is compared with a predetermined value $p_2$. $p_2$ is set to a value which is much smaller than the absolute value of the intake negative pressure, for example, +several 10 mmHg.

In the step S41, it is determined whether $P_0-P \geqq p_2$, the routine proceeds to a step S42, and the timer value $T_3$ which measures the elapsed time since the purge cut valve 9 was opened, is entered in a parameter $DT_3$. Also, in a step S43, "1" is entered in a stage 4 flag. When $P_0-P<p_2$ in the step S41, the timer value $T_3$ is compared with the predetermined time $t_4$, and when $T_3 \geqq t_4$, the routine proceeds to steps S42 and S43.

The predetermined time $t_4$ is set to, for example, several minutes.

Figure 7D:
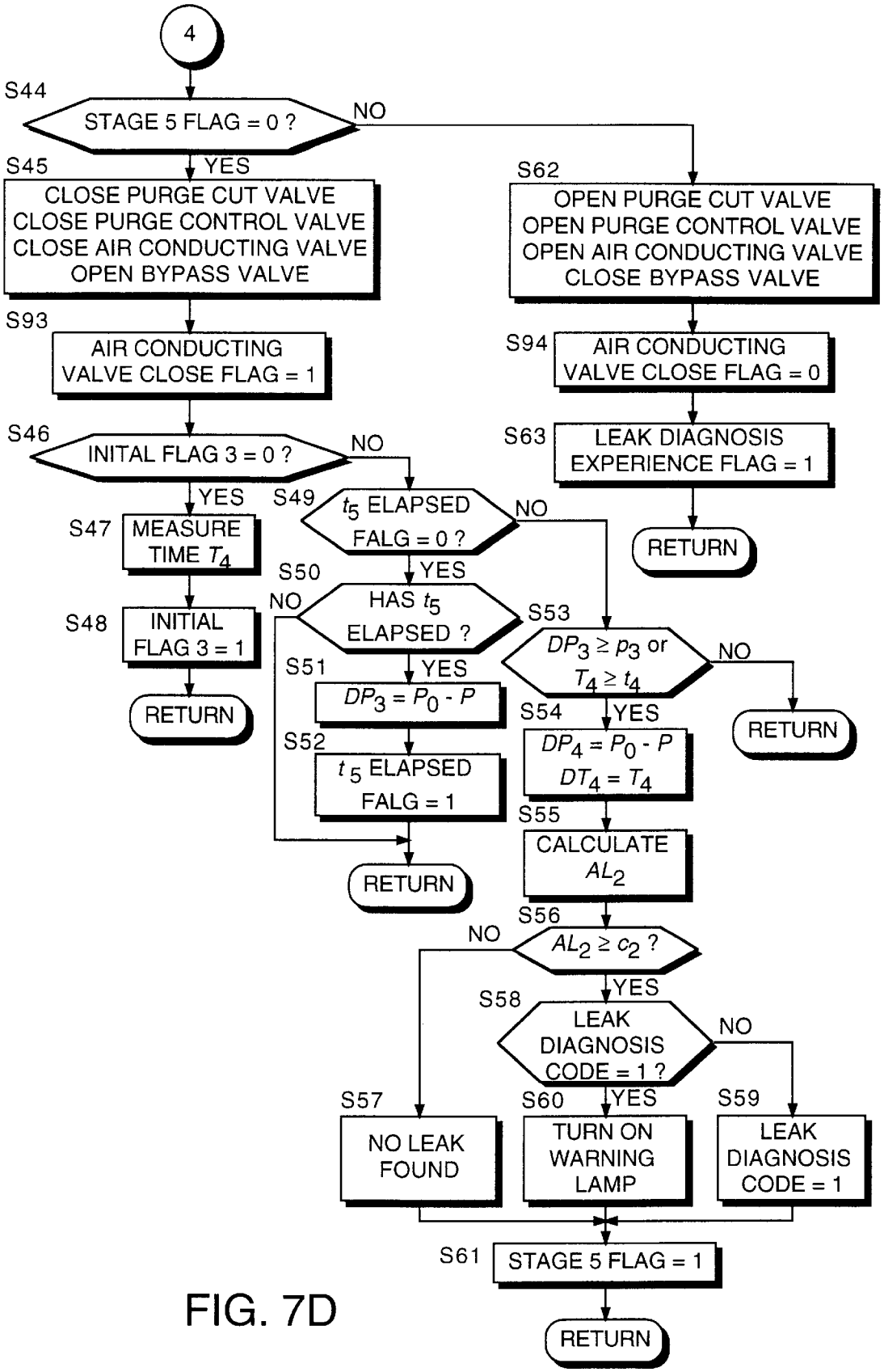

By setting the stage 4 flag to "1" in the step S43, the process proceeds from the step S36 to a step S44 of FIG. 7D on the next occasion. In the step S44 of FIG. 7D it is determined whether or not a stage 5 flag is "0". When the stage 5 flag=0, the routine proceeds to a step S45, the purge cut valve 9, purge control valve 11, air conducting valve 12 are closed, and the bypass valve 14 is opened. In this way, sections from the fuel tank 1 to the purge cut valve 9 are sealed.

In a step S46, it is determined whether or not an initial flag 3 is "0".

When the initial flag 3=0, a timer is started to measure a time $T_4$ in a step S47, and the initial flag 3 is set to "1" in a step S48. The time $T_4$ corresponds to the elapsed time since the purge cut valve 9 was closed.

By setting the initial flag 3 to "1", the process proceeds from the step S46 to a step S49 on the next occasion. In a step S49, it is determined whether or not a $t_5$ elapsed flag is "0". When the $t_5$ elapsed flag=0, the routine proceeds to a step S50, and it is determined whether or not a predetermined time $t_5$ has elapsed since the purge cut valve 9 was closed by comparing the time $T_4$ and time $t_5$.

The predetermined time $t_5$ corresponds to the time required from when gas flow stops after closing the purge cut valve 9 to when pressure loss disappears, and is set to, for example, several seconds. When the predetermined time $t_5$ has passed, the differential pressure $P_0-P$ between the initial pressure $P_0$ and the flowpath pressure P at that time is entered in the parameter $DP_3$.

In a step S52, the $t_5$ elapsed flag is set to "1". Due to this, the process proceeds from the step S49 to the step S53 on the next occasion. Here, the predetermined value $p_3$ is compared with $DP_3$. The predetermined value $p_3$ is set to, for example, +several mmHg.

When $DP_3 \geqq p_3$, the differential pressure $P_0-P$ between the initial pressure $P_0$ and flowpath pressure P at that time is entered in the parameter $DP_4$ in a step S54. Also, the timer value $T_4$ which started in the step S47 is entered in the parameter $DT_4$.

On the other hand, when $DP_3<p_3$, the timer value $T_4$ is compared with the predetermined time $t_4$, and when $t_4 \geqq T_4$, the routine proceeds to the step S54.

Due to the above process, four sampling values are obtained, i.e. two pressure sampling values or the values entered in the parameters $DP_3$, $DP_4$, and two time sampling values or the values entered in the parameters $DP_3$, $DP_4$ .

In a step S55, the leak hole area $AL_2$ is calculated from the four sampling values using the aforesaid expressions (2) and (3). The processing from the step S56 to a step S61 is the same as the processing from the step S18 to S23 of FIG. 7B.

When the stage 5 flag is set to "1" in the step S61, the process proceeds from the step S44 to a step S62 on the next occasion.

In the step S62, the purge cut valve 9, purge control valve 11 and air conducting valve 12 are opened and the bypass valve 14 is closed to release purge stop as in the step S24.

Subsequently, the leak diagnosis experience flag is set to "1" in the step S63 so that leak diagnosis is not performed until the engine stops and restarts.

A positive pressure diagnosis flag determined in the step S3 of FIG. 7A, is set by the process of FIG. 8. This process is executed at a fixed time when the ignition switch is ON.

In a step S71, it is determined whether or not the time is immediately after the starter switch has been switched from ON to OFF. When the time is immediately after the ignition switch has been switched ON, it is determined that the engine is starting up, and a fuel temperature TFN detected by the fuel temperature sensor 15 is entered in a parameter TFINT in a step S72. Also, it is determined that the time is immediately after the starter switch has been switched from OFF to ON only once in the engine startup process.

Figure 9:
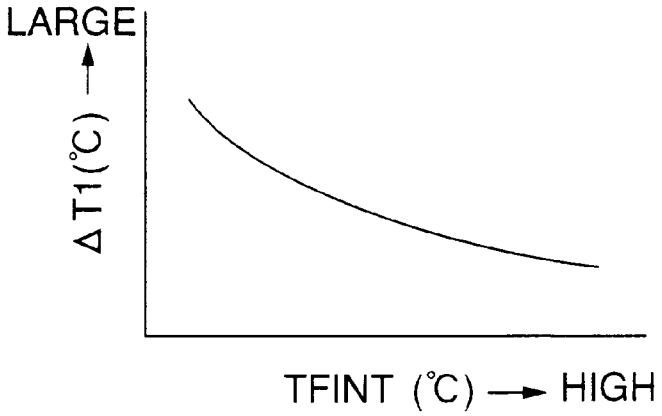
FIG. 9 is a diagram showing a characteristic of a predetermined value $\Delta t_1$ used by the diagnostic device.

In a step S73, a predetermined value $\Delta T_1$ (°C.) is found by looking up a table having the content of FIG. 9 from the parameter TFINT. In a step S74, a predetermined value TMEVD (min) is found by looking up a table in FIG. 10.

In a step S75, a timer is started. This timer value TMST is a time corresponding to the elapsed time from engine startup. At the time when the process is next executed, the process proceeds from the step S71 to a step S76 because it is not immediately after engine startup.

In a step S76, a temperature difference TFN−TFINT between a present fuel temperature and a startup fuel temperature is compared with a predetermined value $\Delta T_1$. When TFN−TFINT$\geqq \Delta T_1$, it is determined that there has been a large fuel temperature rise after startup, and a positive pressure diagnosis flag is set to "1" in a step S77.

At startup, the positive pressure diagnosis flag is initialized to "0". In order to obtain a positive pressure of for example +5 mmHg which is necessary for leak diagnosis, a large amount of fuel vapor must be produced in the fuel tank, and when the fuel temperature rise after startup is large, it is determined that a large amount of fuel vapor is produced. The positive pressure diagnosis flag is therefore set to "1".

Even when TFN−TFINT$<\Delta T_1$, the predetermined value TMEVD is compared with the timer value TMST in a step S78, and when TMST$\geqq$TMEVD, the routine proceeds to the step S77. The reason why the positive pressure diagnosis flag is set to "1" when a time equal to or greater than the predetermined TMEVD has elapsed from startup, is that it may be assumed that the positive pressure necessary for leak diagnosis was obtained from the fuel vapor produced while the predetermined time TMEVD was passing.

In other words, it is assumed that production of fuel vapor in the fuel tank required for leak diagnosis has been completed because the rise of fuel temperature reached a predetermined value or a predetermined time elapsed after engine startup. The aforesaid predetermined value $\Delta T_1$ is larger the lower the fuel temperature TFINT on engine startup, as shown in FIG. 9. This is due to the fact that even for the same temperature rise, less fuel vapor is produced when the startup fuel temperature is low than when it is high.

Figure 10:
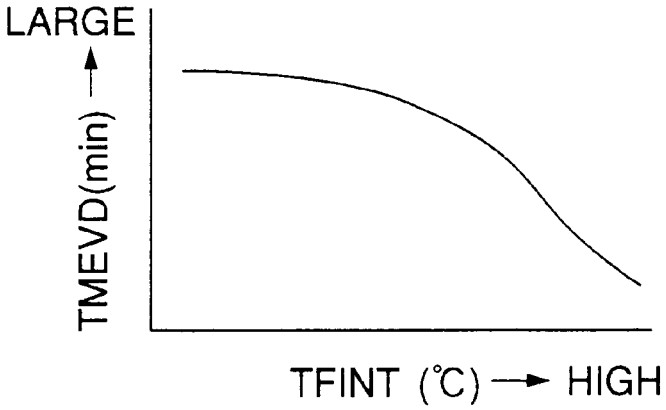
FIG. 10 is a diagram showing a characteristic of a predetermined value TMEVD used by the diagnostic device.

The predetermined value TMEVD is also arranged to be larger the lower the startup fuel temperature TFINT, as shown in FIG. 10. This is because the amount of fuel vapor produced is less the lower the startup fuel temperature, for the same elapsed time after startup. However, the predetermined values $\Delta T_1$ and TMEVD may also be set to constant values so as to simplify the process.

The above-mentioned leak diagnosis process is basically known from U.S. Pat No. 5,542,397.

During refueling, a filler cap at the upper end of the filler tube is removed in order to pour in the fuel. To prevent fuel vapor being discharged into the atmosphere from the filler tube at this time, the fuel tank to which this invention is applied has the construction shown in FIG. 11. The upper surface of the fuel tank 1 is formed with a step, and a vent tube 32 connected to the canister 4 opens into a lower part 1*a* of the step.

The vent tube comprises a tank side vent tube 32*a* and a canister side vent tube 32*b*. The canister side vent tube 32*b* is connected to the tank side vent tube 32*a* via a control valve 33. A float valve 45 is provided in an opening of the vent tube 32 leading to the fuel tank 1 in order to prevent fuel in the fuel tank 1 from flowing into the canister 4.

The vapor passage 2 opens into a higher part 1*b* of the step of the fuel tank 1, and a float valve 46 is provided in this opening.

The control valve 33 comprises a pressure chamber 33*b* in the upper part which is partitioned off by a diaphragm 33*a*. The diaphragm 33*a* is pushed downwards by a spring 33*c* in the pressure chamber 33*b*, and thereby seals the upper end of the tank side vent tube 32*a*.

During refueling, negative pressure in an air trap 39 is led to the pressure chamber 33*b* via a signal tube 35, and the pressure in the tank 1 rises due to introduction of fuel. A force depending on the difference between these two pressures displaces the diaphragm 33*a* in opposition to the diaphragm spring 33*c,* and this connects the tank side vent tube 32*a* and canister side vent tube 32*b*.

Figure 13:
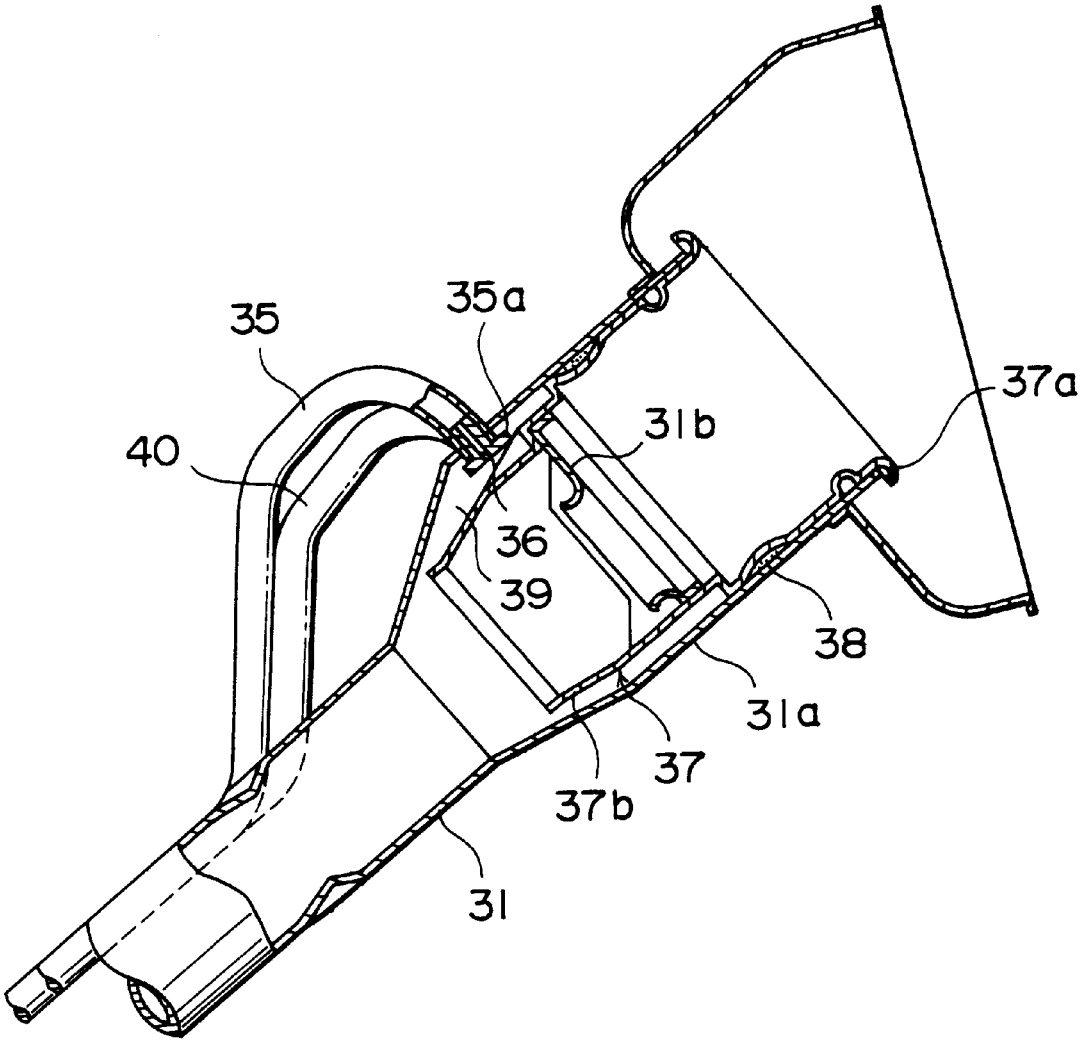
FIG. 13 is a vertical sectional view of a signal tube connector of the filler tube.
Figure 14:
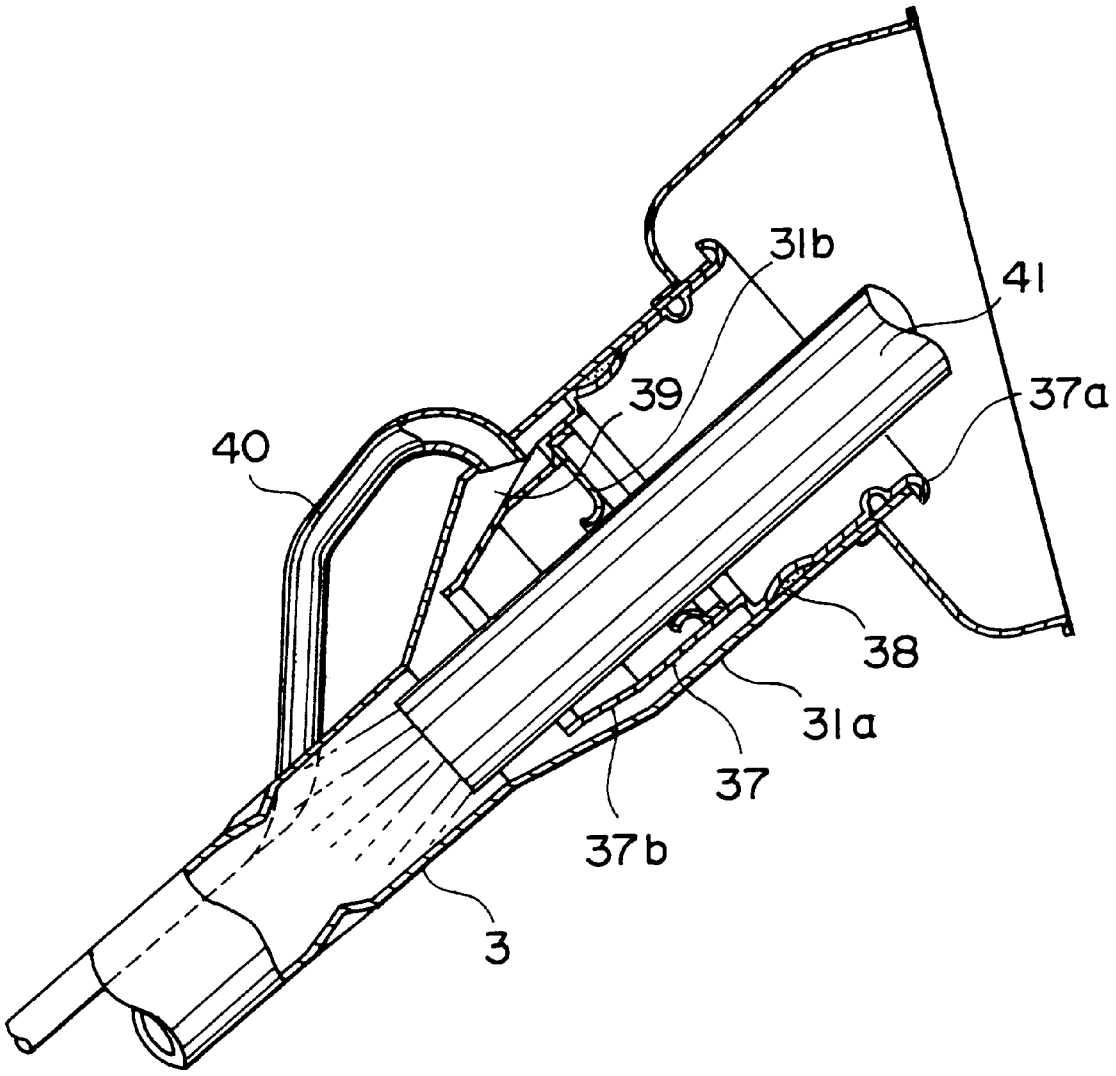
FIG. 14 is a vertical sectional view of a circulation tube connector of the filler tube.

A large diameter part 31*a* is formed in the upper part of the filler tube 31. A cylindrical body 37 which progressively becomes thinner towards its base is inserted in this large diameter part 31*a*. Specifically, as shown in FIG. 13, this cylindrical body 37 is inserted until a flange 37*a* formed at its upper end comes in contact with the rim of the large diameter part 31*a*. A sealing material 38 is filled between the outer circumference of the cylindrical body 37 and the inner circumference of the large diameter part 31*a* of the filler tube over the whole circumference. A small diameter part 31*b* which slides on the outer circumference of a fuel nozzle 41 is also provided on the inside of the large diameter part 31*a,* as shown in FIG. 14. As the fuel nozzle 41 inserted in the filler tube 31 slides on the small diameter part 31*b,* fuel vapor is prevented from leaking from the filler tube 31 to the outside during refueling.

The air trap 39 which opens downwards is formed between the cylindrical body 37 beneath the sealing material 38 and the large diameter part 31*a* of the filler tube. The signal tube 35 and a circulation tube 40 open into this air trap 39.

Figure 11:
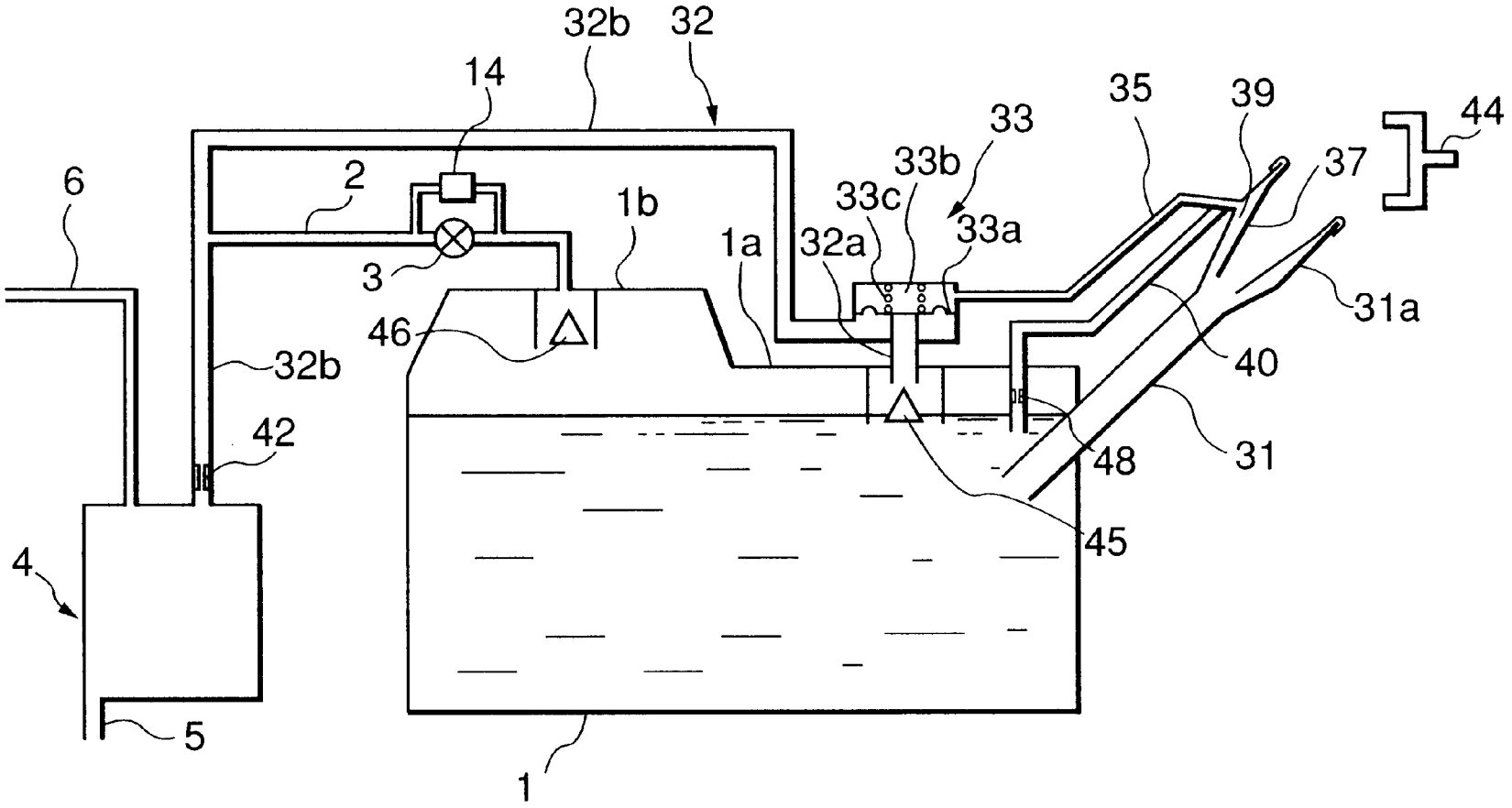
FIG. 11 is a schematic view of a fuel tank to which this invention is applied.
Figure 12:
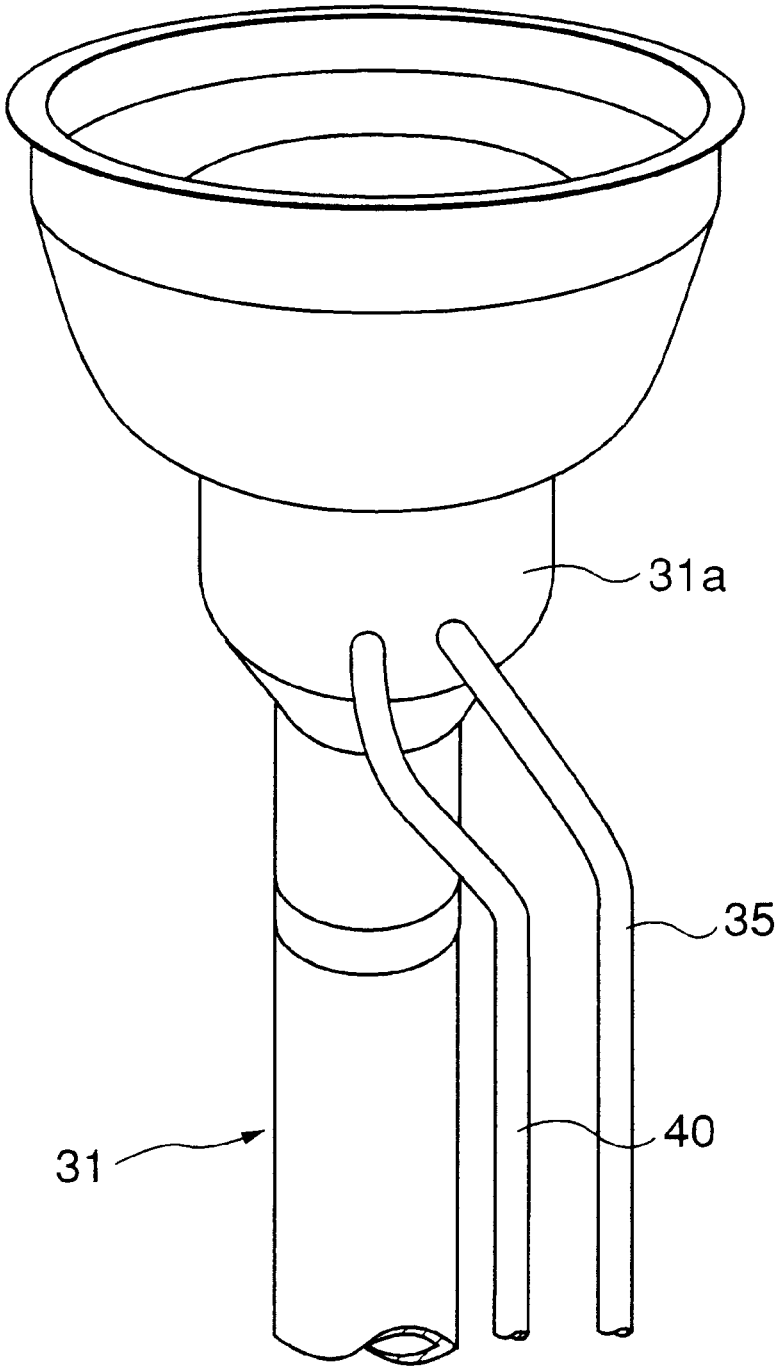
FIG. 12 is a perspective view of a filler tube of the fuel tank.

A volume $V_1$ of the air trap 39 is set so that the relation:

$$V1 \geq V2 \cdot \frac{p_2}{p_1}$$

is satisfied, where $V_2$ is the volume of the signal tube 35, $p_1$ is atmospheric pressure, and $p_2$ is a cap valve opening pressure. The cap valve opening pressure $p_2$ is an opening pressure of a gas discharge mechanism with which the filler cap 44 shown in FIG. 11 is provided, and which operates when the tank internal pressure rises abnormally.

The signal tube 35 is provided with an engaging member 35*a* having an orifice 36 which projects into the air trap 39, as shown in FIG. 13.

The orifice 36 prevents entry of fuel into the signal tube 35 from the filler tube 31, by making air in the air trap 39 enter the orifice 36 before fuel when the vehicle is turning.

The end of the circulation tube 40 projects inside the air trap 39 as shown in FIG. 14. The circulation tube 40 supplies fuel vapor in the upper part of the fuel tank 1 to the filler tube 31 in order to decrease the quantity of outside air brought into the filler tube 31 from the atmosphere during refueling.

When a refueling nozzle 41 is inserted in the filler tube 31 as shown in FIG. 14, the air trap 39 which is situated above the end of the nozzle 41 is at a negative pressure. Due to this negative pressure, fuel vapor in the upper part of the fuel tank 1 is supplied to the filler tube 31. The fuel vapor passes through the filler tube 31 together with fuel discharged from the refueling nozzle 41, and then re-enters the fuel tank 1. A lower part 37*b* of the cylindrical body 37 acts as a guide for fuel vapor which is supplied to the air trap 39 from the circulation tube 40 and moves towards the lower part of the filler tube 31.

An orifice 48 shown in FIG. 11 is provided in the vicinity of the lower end of the circulation tube 40 in order to limit the quantity of fuel vapor supplied to the fuel trap 39 from the upper part of the fuel tank 1. The orifice 48 is set so that a recirculation amount of fuel vapor does not exceed an amount of air aspirated into the fuel tank due to fuel inflow negative pressure during refueling. Moreover, an orifice 42 is provided also in the canister side vent tube 32*b* in order to limit the flowrate of fuel vapor entering the canister 4 via the vent tube 32. This is done in order to make it easier to supply fuel vapor in the upper part of the fuel tank 1 to the filler tube 31 via the circulation tube 40.

Openings to the signal tube 35 and circulation tube 40 are formed at substantially the same height and slightly separated in the horizontal direction. During refueling, the filler cap 44 is removed, the refueling nozzle 41 is inserted in the filler tube 31 from the large diameter part 31*a,* and a trigger of the refueling nozzle 41 is pulled. This causes fuel discharged from the end of the refueling nozzle 41 to flow into the filler tube 31. Negative pressure produced in the air trap 39 is then led to the pressure chamber 33*b* of the control valve 33 via the signal tube 35, and the pressure in the tank 1 becomes higher than atmospheric pressure due to inflow of fuel. A pressure difference therefore occurs on both sides of the diaphragm 33*a* of the control valve 33, and the control valve 33 opens due to this pressure difference so that the tank side vent tube 32*a* and canister side vent tube 32*b* are connected. As a result, fuel vapor in the upper part of the tank 1 is led to the canister 4 via the vent tube 32, fuel particles contained in the fuel vapor are adsorbed by active carbon, and only air is discharged into the atmosphere from the atmospheric discharge port 5. Accordingly, refueling can be performed without discharging fuel vapor in the fuel tank 1 into the atmosphere.

When the fuel tank 1 is filled with fuel, a float of the float valve 45 rises so as to seal an opening of the vent tube 32*a*. The lower end of the circulation tube 40 is also immersed in fuel.

When the maximum amount of fuel has been filled, an air layer remains only in the vicinity of the higher part 1*b* and the oil surface reaches the upper part of the filler tube 31.

When the pressure in the tank 1 increases beyond a fixed value in the state where the filler cap 44 seals the filler tube 31, the increased pressure acts on the pressure chamber 33*b* via the signal tube 35, and the pressure chamber 33*b* and tank side vent tube 32*a* are then at the same pressure. As a result, the control valve 33 is closed.

Next, the case will be considered where refueling is performed during the time leak diagnosis is being carried out in a vehicle comprising the fuel tank 1 having the aforesaid construction and the above-mentioned leak diagnostic device.

During leak diagnosis, both the air conducting valve 12 of the canister 4 and purge cut valve 9 are closed, so fuel vapor in the fuel tank 1 cannot flow into the canister 4 even when the control valve 33 is open. As a result, fuel does not enter the fuel tank 1 even if fuel is poured into the filler tube 31 from the fuel nozzle 41.

To resolve this problem, the leak diagnostic device stops leak diagnosis promptly if refueling is detected during leak diagnosis, and opens the air conducting valve 12.

Figure 15:
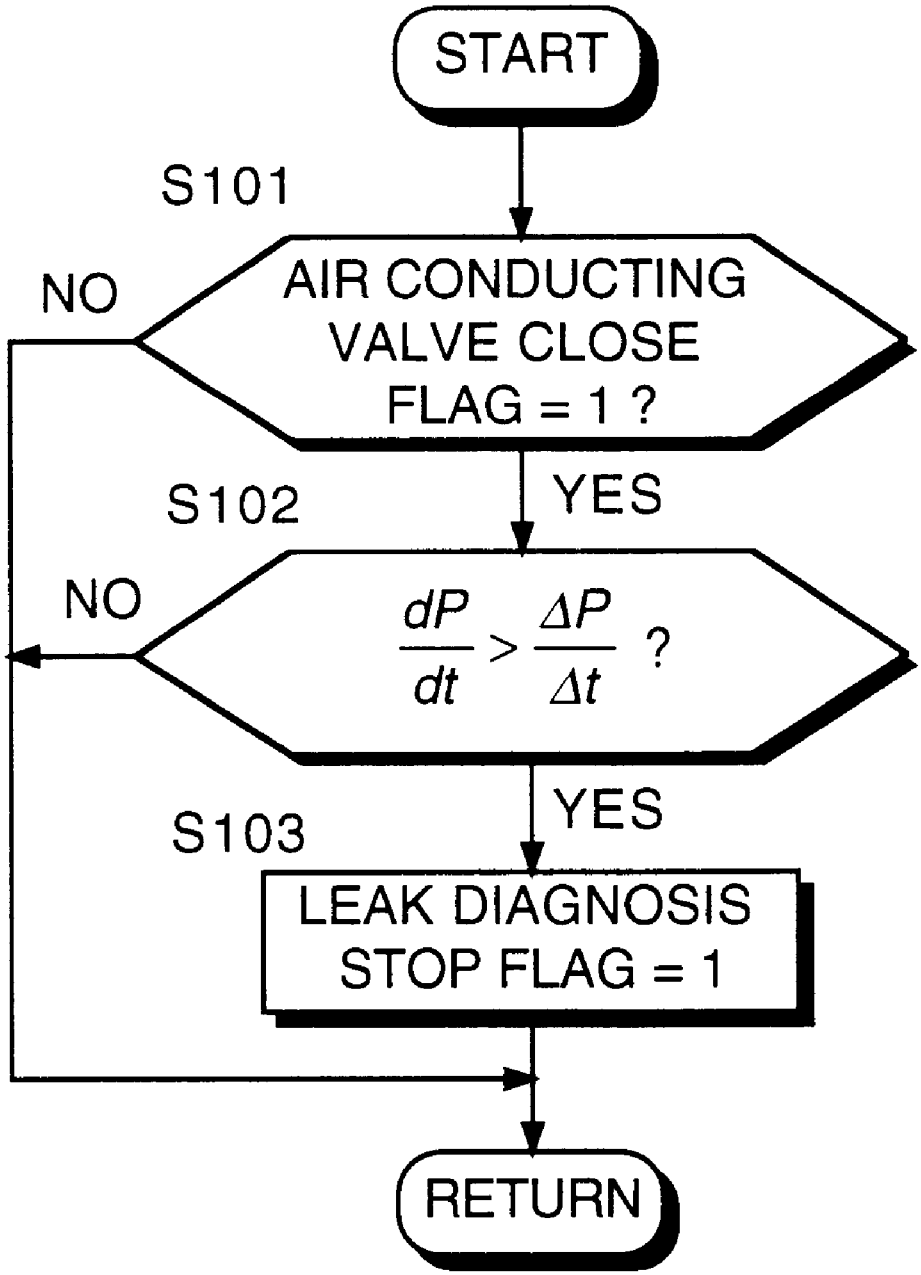
FIG. 15 is a flowchart describing a setting process of a diagnosis stop flag performed by the diagnostic device.

This is implemented by steps S81–S85 and steps S91–S94 of FIGS. 7A–7D, and an additional process shown in FIG. 15.

The flowchart of FIG. 15 shows a leak diagnosis stop flag setting process.

This process is executed, for example, every ten milliseconds.

In a step S101, it is determined whether or not an air conducting valve close flag is "1". The air conducting valve close flag is a flag set according to an opening and closing operation of the air conducting valve 12 in stages 1–5 shown in FIGS. 4A–4E and FIGS. 5A–5E.

In a process of FIGS. 7A–7E, the air conducting valve is closed in the step S5, steps S11, S24, S33, S37 and S45.

Correspondingly, the air conducting valve close flag is set to "1" in the steps S83, S84, S91, S92 and S93. Also, in the steps S24, S62, the air conducting valve 12 is opened, and the air conducting valve close flag is therefore reset to "0" in the steps S85, S94. Hence, the air conducting valve close flag=1 shows that the air conducting valve 12 is closed, and the air conducting valve close flag=0 shows that the air conducting valve 12 is open.

On engine startup, the air conducting valve close flag is initialized to "0". Therefore, when the air conducting valve close flag=1, it is determined in a step S101 of FIG. 15 that leak diagnosis is being performed, and in a step S102, it is determined whether or not the flowpath pressure P detected by the pressure sensor 13 is equal to or greater than a predetermined value ΔP for a predetermined time Δt. When the flowpath pressure P is determined to be equal to or greater than the predetermined value ΔP for the predetermined time Δt, it is determined that refueling is being performed. In this case, the leak diagnosis stop flag is set to "1" in a step S103, and the leak diagnosis stop flag is initialized to "0" on engine startup. In the leak diagnosis process of FIGS. 7A–7E, the leak diagnosis stop flag is determined in a step S81 immediately after the start of the diagnosis process.

When the leak diagnosis stop flag=1, the routine proceeds to a step S82 and the air conducting valve 12 is opened. In this case, the routine cannot proceed to the step S1 and subsequent steps, so during this run of the engine, leak diagnosis is not completed.

Figures 16A, 16B, 16C:
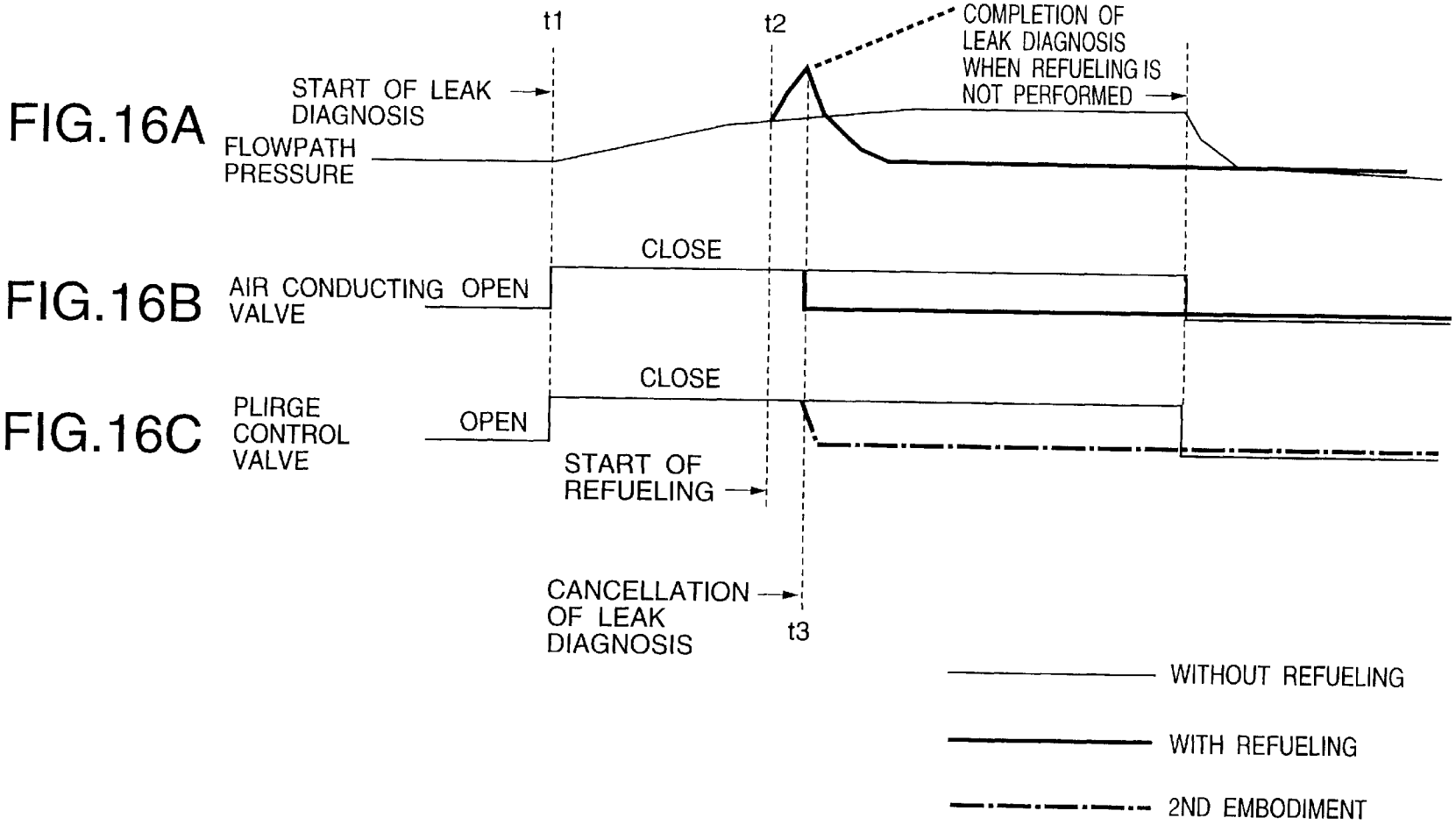
FIGS. 16A–16C are timing charts describing the situation when refueling was performed during leak diagnosis according to this invention.

FIGS. 16A–16C show variation of flowpath pressure when leak diagnosis is performed using positive pressure according to the aforementioned leak diagnosis process, and refueling is performed during the diagnosis.

When leak diagnosis start conditions hold at a time $t_1$ while the vehicle is traveling and the positive pressure diagnosis condition flag=1, the purge cut valve 9, purge control valve 11 and air conducting valve 12 are all closed, the bypass valve 14 is opened, and leak diagnosis is started using positive pressure. As the air conducting valve 12 is closed, the air conducting valve close flag is set to "1". Subsequently, the vehicle is stopped and without stopping the engine, the filter cap 44 is removed and refueling is performed at the time $t_2$.

Due to the inflow of fuel into the fuel tank, the pressure in the fuel tank suddenly rises, the air conducting valve 12 opens at a time $t_3$ when the flowpath pressure P becomes equal to or greater than the predetermined value ΔP for the predetermined time Δt, and leak diagnosis is stopped by this pressure increase. As a result, fuel vapor in the upper part of the fuel tank is flushed out into the canister 4 via the vent tube 32 according to the inflow of fuel, and fuel flows into the fuel tank 1 smoothly.

Therefore, refueling is performed without any problem even when, for example, refueling is performed during leak diagnosis and it is forgotten to stop the engine.

According to this embodiment, as shown in FIGS. 16A–16C, the case was described where refueling was performed during leak diagnosis using positive pressure, however refueling may also be performed during leak diagnosis using negative pressure.

For example, in FIGS. 5A–5E and FIGS. 6A–6E, the flowrate in the purge passage 6 is, for example, 7 liter/min when the purge control valve 11 is set to a predetermined small opening in order to introduce negative pressure. However, the flowrate in the vapor passage 2 during refueling is at least 10 times greater. Therefore, even when refueling is performed while negative pressure is introduced, the flowpath pressure P in the purge passage 6 rises suddenly, and the pressure change is equal to or greater than the predetermined value ΔP for the predetermined time Δt.

According to this embodiment, the invention was applied to a diagnostic device which performs leak diagnosis using either positive or negative pressure, but it may be applied also to a leak diagnostic device which uses only positive pressure or a leak diagnostic device which uses only negative pressure. Also, in this embodiment, a bypass valve 14 for bypassing the pressure control valve 3 was provided, but when leak diagnosis is performed using only positive pressure, the pressure control valve 3 is not required. It is sufficient if there is a valve which opens and closes the vapor passage 2 according to a signal from the control unit 21, which for example corresponds to the bypass valve 14.

Figure 17:
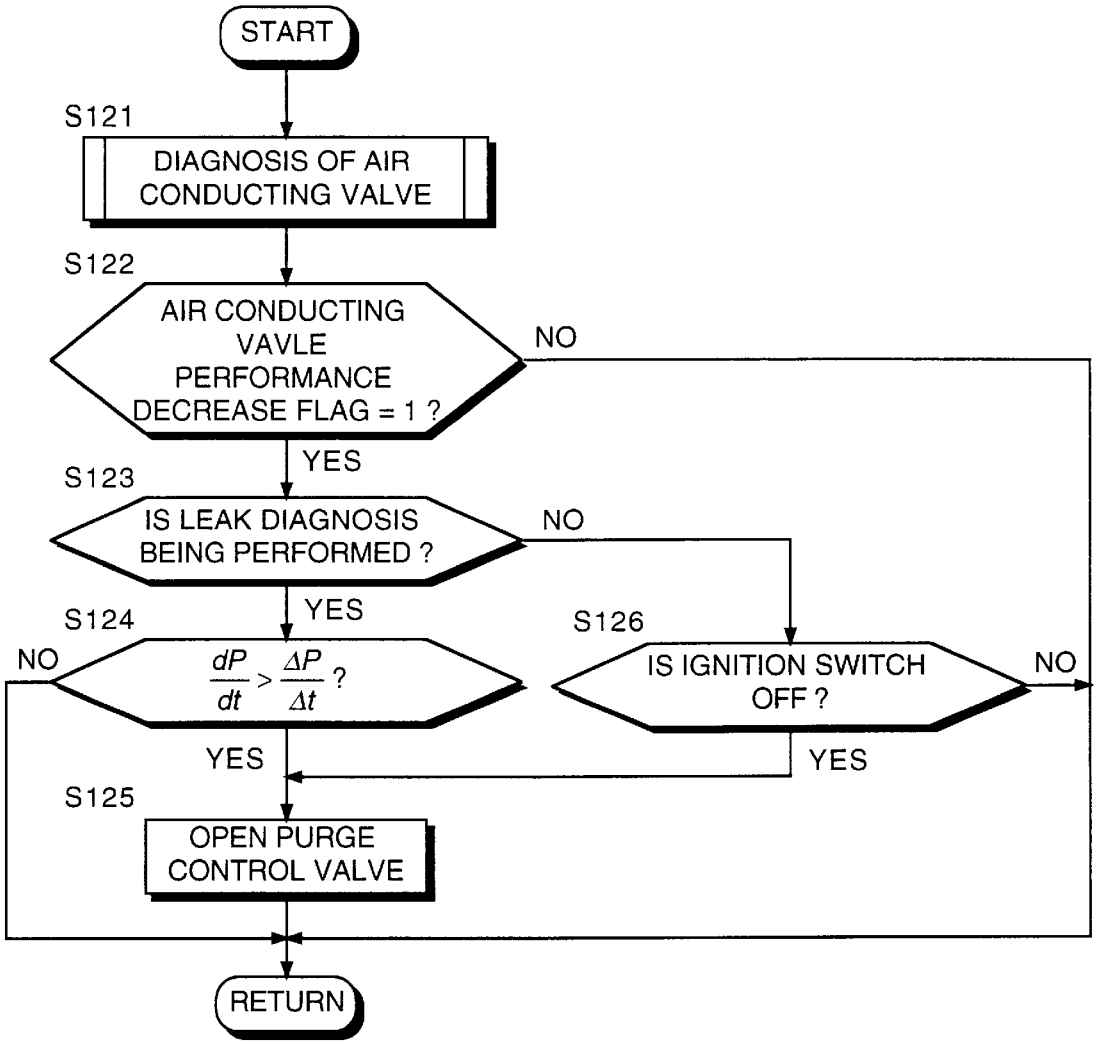
FIG. 17 is a flowchart corresponding to a second embodiment of this invention, describing a fail-safe process according to this diagnostic device when an air conducting valve is fixed in a closed state.
Figure 18:
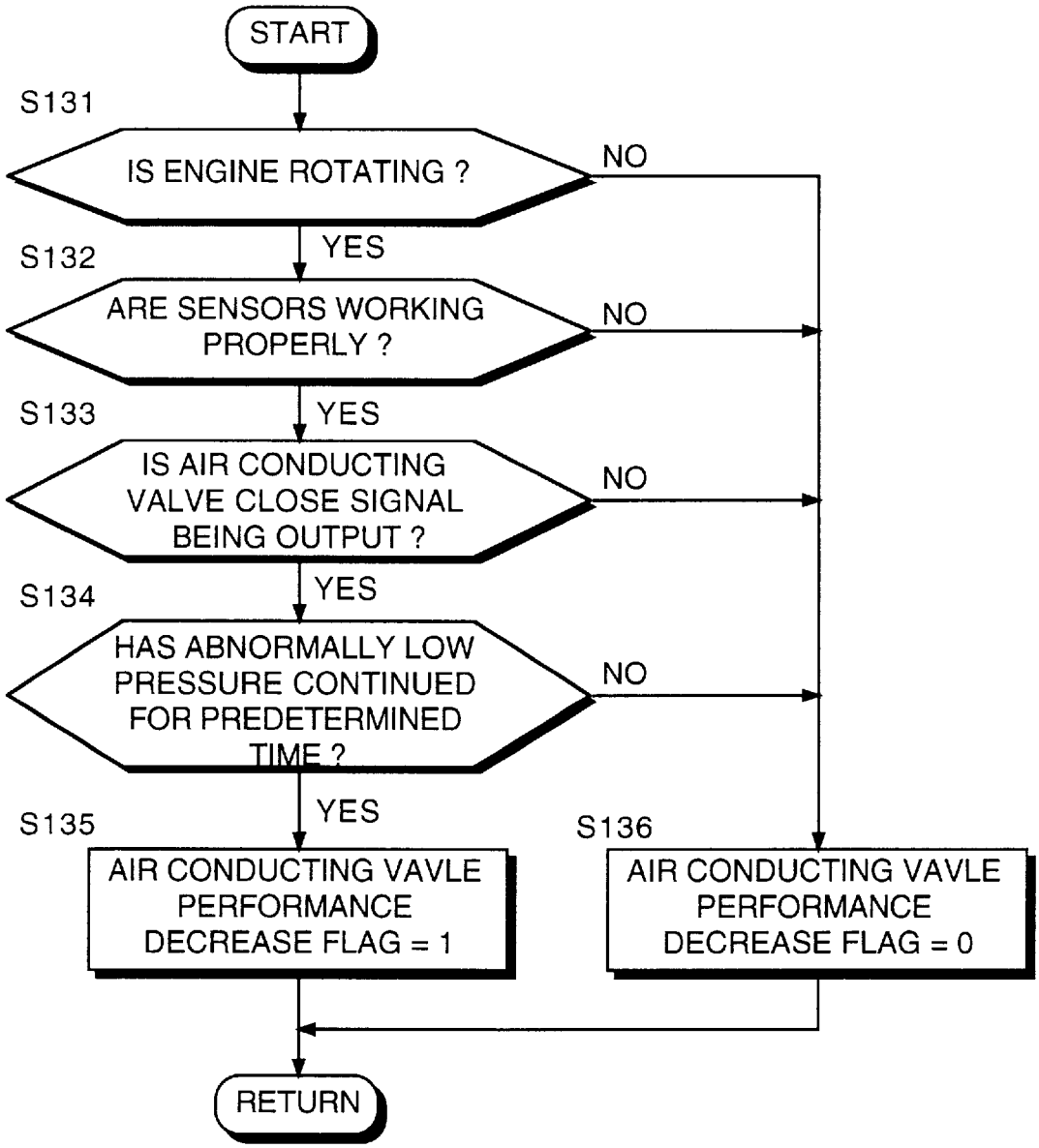
FIG. 18 is a flowchart corresponding to the second embodiment of this invention, describing a determining process for determining whether or not the drain cut valve was fixed in the closed state performed by the diagnostic device.

FIGS. 17 and 18 show a second embodiment of this invention.

According to this embodiment, instead of providing the purge cut valve 9 and purge control valve 11 as in the first embodiment, the invention is applied to a fuel vapor processing device comprising only the purge control valve 11. Leak diagnosis is therefore performed on the flowpath from the fuel tank 1 to the purge control valve 11. According to the first embodiment, it was assumed that there is no abnormality in the opening and closing action of the air conducting valve 12, and that there is almost no clogging of the atmospheric connection port 5.

The air conducting valve 12 is a valve which is closed when a current flows in a solenoid so as to generate a magnetic force only when, for example, an ON signal is supplied. In such a case, it may occur that the air conducting valve 12 does not return to the fully open position due to deterioration even when an OFF signal is supplied to the air conducting valve 12.

Further, it may occur that the air conducting valve 12 or atmospheric connection port 5 clogs. In this case, pressure losses are larger when air is discharged to the atmosphere from the atmospheric connection port 5, so it becomes correspondingly more difficult for fuel vapor to flow from the fuel tank 1 to the canister 4, and the fuel inflow speed to the fuel tank 1 during refueling is slower. To resolve this problem, according to this embodiment, when it is determined that the air conducting valve 12 or atmospheric connection port 5 is not properly open, the purge control valve 11 is opened both for refueling during leak diagnosis and for refueling during a normal engine stop.

The operating state of the purge control valve 11 in this case is shown by a dotted line in FIG. 16C.

Although the flowrate for the aforesaid predetermined small opening of the purge control valve 11 is of the order of 7 liter/min, the flowrate through the air conducting valve 12 is at least 10 times greater. In this case, pressure losses increase when air escapes to the atmosphere from the atmospheric connection port 5, and when the flowrate through the air conducting valve 12 has decreased to about 9 times, the flowrate corresponding to the decrease, i.e. 7 liter/min, is discharged through the purge control valve 11. Therefore when the air conducting valve 12 is stuck in the fully closed position, inflow of fuel to the fuel tank becomes extremely slow and it is almost impossible to perform refueling even when the purge control valve 11 is fully opened.

The purpose of this embodiment is to provide compensation when the flowrate through the air conducting valve 12 is less than specified due to clogging of this valve or of the atmospheric connection port 5.

The aforesaid process will now be described referring to the flowchart of FIG. 17.

This routine is executed at an interval of, for example, 10 milliseconds.

In a step S121, it is determined whether or not there has been a decrease of performance of the air conducting valve 12.

This determination is performed by the subroutine of FIG. 18.

An engine to which this embodiment is applied comprises a crank angle sensor for detecting an engine rotation.

In the subroutine of FIG. 18, the following conditions are determined.

(1) The engine is rotating (step S131)

(2) The crank angle sensor and pressure sensor are not defective (step S132)

(3) A close signal (OFF signal) is output from the control unit 21 to the air conducting valve 12 (step S133)

When all of the above conditions (1)–(3) are met, it is determined that the condition for determining decreased performance of the air conducting valve holds, and the routine proceeds to a step S134.

In the step S134, it is determined whether or not a state wherein the flowpath pressure P measured by the pressure sensor 13 is abnormally low, has continued for a predetermined time.

This is due to the following reason.

When purge is performed, intake negative pressure is led into the purge passage 6, and adsorbed fuel is purged from the canister 4*a* by atmospheric air which is aspirated from the atmospheric connection port 5 via the air conducting valve 12.

When the air conducting valve 12 is no longer able to supply a predetermined flowrate of atmospheric air, the pressure in the purge passage 6 falls. Therefore, when the flowpath pressure P remains abnormally low for a predetermined time, it is determined that there is a fault in the air conducting valve 12 or atmospheric connection port 5.

When purge of adsorbed fuel from the canister 4*a* is not performed, the purge cut valve 9 is closed and intake negative pressure is not introduced into the purge passage 6, so the pressure in the purge passage 6 does not become negative.

When it is determined in the step S134 that the flowpath pressure P has remained abnormally low for a predetermined time, an air conducting valve performance decrease flag is set to "1" in a step S135. This flag is initialized to "0" on engine startup. When the flowpath pressure P has not remained abnormally low for a predetermined time, or when any of the above conditions (1)–(3) is not satisfied, the routine proceeds to a step S136, and the air conducting valve performance decrease flag is reset to "0".

When determination of performance decrease of the air conducting valve is complete, the routine returns to the step S122 of FIG. 17.

Herein, when the air conducting valve performance decrease flag=1, the routine proceeds to the step S123. In the step S123, it is determined whether or not leak diagnosis is being performed. When leak diagnosis is being performed, it is determined whether or not a variation of the flowpath pressure P is equal to or greater than the predetermined value $\Delta P$ for the predetermined time $\Delta t$.

When both the determining results of the steps S123, S124 are affirmative, it signifies that refueling is being performed during leak diagnosis. In this case, the routine proceeds to the step S125, and the purge control valve 11 is opened.

When it is determined in the step S123 that leak diagnosis is not being performed, the routine proceeds to the step S126, and it is determined whether or not the ignition switch is OFF.

When the ignition switch is OFF, i.e. when the engine has stopped, the routine proceeds to the step S125 and the purge control valve 11 is opened. When the engine has not stopped, the routine is terminated.

According to this embodiment, when there is a decrease of performance of the air conducting valve 12 or atmospheric connection port 5, and refueling was performed, the purge control valve 11 was opened, but leak diagnosis was not stopped.

It is however possible also to stop leak diagnosis when the purge control valve 11 is opened as in the case of the aforesaid first embodiment.

In the step S124, it is determined that refueling is being performed when the flowpath pressure P is equal to or greater than the predetermined value $\Delta P$ for the predetermined time $\Delta t$, however it may be determined that refueling is being performed when a filler cap switch, described hereafter, is OFF.

According to this second embodiment, refueling may be performed rapidly even when pressure losses are large when air escapes to the atmosphere from the atmospheric connection port of the canister 4, due to the fact that the air conducting valve 12 cannot return to the fully open position as a result of aging, the valve becomes fixed in a slightly closed position, or approximately the same amount of logging occurs in the atmospheric connection port 5 of the canister 4.

Figure 19:
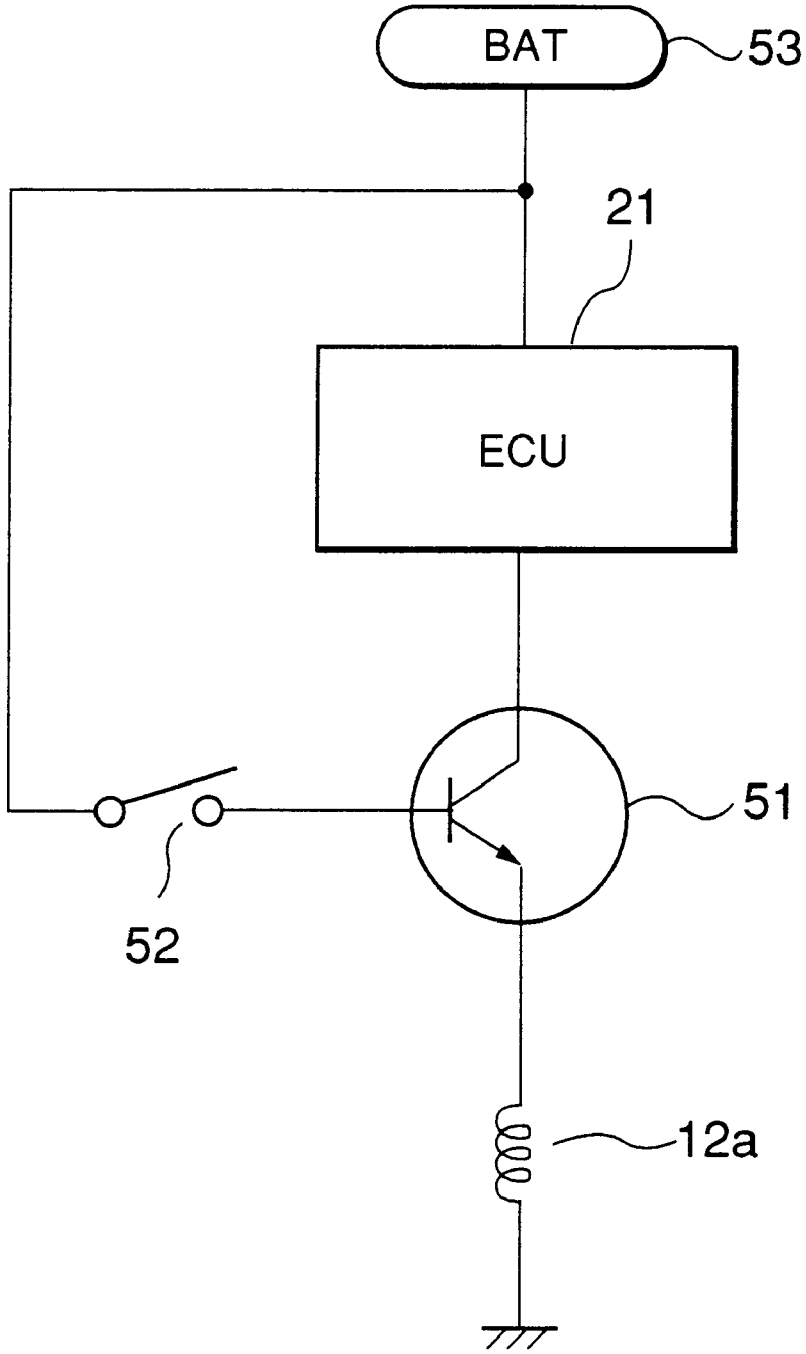
FIG. 19 is an electrical circuit diagram corresponding to a third embodiment of this invention for opening the air conducting valve if refueling is performed during leak diagnosis.

FIG. 19 shows a third embodiment of this invention.

According to this embodiment, when the filler cap 44 is removed, i.e. when refueling is performed, power to the air conducting valve 12 is forcibly cut off.

The air conducting valve 12 is a valve which is normally open, and it is so constructed that when an ON signal is received from the control unit 21, a current flows in a solenoid 12*a* so that the valve closes.

According to this embodiment, a power transistor 51 is interposed in the signal line connecting the control unit 21 and solenoid 12*a*.

The base of the power transistor 51 is connected to a battery 53 via a filler cap switch 52. The filler cap switch 52 is a switch which reacts to the conditions of the filler cap 44.

The filler cap switch 52 is ON when the filler cap 44 is attached to the filler tube 31, and OFF when the filler cap 44 is removed from the filler tube 31.

When the filler cap switch 52 is ON, a base voltage is applied to the power transistor 51, and when an ON signal is output to the solenoid 12*a* from the control unit 21, a collector and emitter of the power transistor 51 become conducting. As a result, a current flows to the solenoid 12*a* from the battery 53 and the air conducting valve 12 closes.

When on the other hand the filler cap switch is OFF, a base voltage is not applied to the power transistor 51, the collector and emitter of the power transistor 51 are not connected, therefore current is not supplied to the solenoid 12*a* regardless of the signal from the control unit 21. The air conducting valve 12 therefore opens.

Accordingly, the air conducting valve 12 opens during refueling even when leak diagnosis is being performed so that refueling may be carried out.

According to this third embodiment, unlike the aforesaid first embodiment, the air conducting valve 12 is opened during refueling by the mechanical construction using the filler cap switch 52 and power transistor 51, hence even if an ON signal is incorrectly issued to the air conducting valve 12 from the control unit 21, the air conducting valve 12 does not close.

Further, according to the aforesaid first and third embodiments, the purge cut valve 9 and purge control valve 11 were provided separately, however this invention may be applied also to the case where only the purge control valve 11 is installed in the purge passage 6 as in the second embodiment.

The purge control valve 9 may also comprise an electromagnetic valve which opens and closes according to a signal from the control unit 21.

The corresponding structures, materials, acts, and equivalents of all means plus function elements in the claims below are intended to include any structure, material, or acts for performing the functions in combination with other claimed elements as specifically claimed.

The embodiments of this invention in which an exclusive property or privilege is claimed are defined as follows:

1. A leak diagnostic device for use with a fuel vapor processor of an engine of a vehicle, said engine comprising a fuel tank, and said processor comprising a canister for temporarily collecting fuel vapor in said fuel tank, a normally-open air conducting valve for connecting said canister to the atmosphere, a vapor passage connecting said fuel tank and said canister, a vapor passage valve for opening and closing said vapor passage, a purge passage connecting said canister and an engine intake passage, and a purge passage valve for opening and closing said purge passage, said device comprising:

a sensor for detecting a pressure in a space comprising any one of the vapor passage, the canister, the purge passage and the fuel tank, and a controller functioning to:

detect engine conditions for performing a leak diagnosis, introduce a test pressure different from atmospheric pressure to said space by controlling any one of said air conducting valve, vapor passage valve and purge passage valve, including closing said air conducting valve, begin said leak diagnosis of said space based on a pressure variation in said space after introducing said test pressure, detect if refueling of said fuel tank is being performed, and if refueling of said fuel tank is being performed while said leak diagnosis is being performed, control said air conducting valve so that said canister is connected to the atmosphere.

2. A leak diagnostic device as defined in claim 1, wherein said controller is further functioning to stop the leak diagnosis if refueling of said fuel tank is being performed.

3. A leak diagnostic device as defined in claim 1, wherein said controller is further functioning to determine that refueling of said fuel tank is being performed when a pressure in said space has increased above a predetermined increase factor.

4. A leak diagnostic device as defined in claim 1, wherein said fuel tank is provided with a filler tube for refueling and a filler cap for sealing the filler tube, said device further comprises a sensor for detecting that the filler cap has been removed, and said control unit is further functioning to determine that refueling of said fuel tank is being performed when said filler cap has been removed.

5. A leak diagnostic device as defined in claim 1, wherein said controller is functioning to introduce a positive pressure in said fuel tank into said space as a test pressure by opening said vapor passage valve.

6. A leak diagnostic device as defined in claim 1, wherein said controller is functioning to introduce an intake negative pressure of said engine into said space as a test pressure by opening said purge passage valve.

7. A leak diagnostic device as defined in claim 1, wherein said controller is further functioning to detect an abnormal low pressure state wherein a large negative pressure exceeding a predetermined level continues to exist for a predetermined time, and when refueling is performed during leak diagnosis after said abnormal low pressure state is detected, open said purge passage valve.

8. A leak diagnostic device as defined in claim 7, wherein said controller is further functioning to detect an engine stop, and when refueling is performed in an engine stop state after said abnormal low pressure state is detected, open said purge passage valve.

9. A leak diagnostic device for use with a fuel vapor processor of an engine of a vehicle, said engine comprising a fuel tank provided with a filler tube for refueling and a filler cap which seals said filler tube, and said processor comprising a canister for temporarily collecting fuel vapor in said fuel tank, a normally-open air conducting valve for connecting said canister to the atmosphere, a vapor passage connecting said fuel tank and said canister, a vapor passage valve for opening and closing said vapor passage, a purge passage connecting said canister and an engine intake passage, and a purge passage valve for opening and closing said purge passage, said device comprising:

a first sensor for detecting a pressure in a space comprising any one of the vapor passage, the canister, the purge passage and the fuel tank, a controller functioning to:

detect engine conditions for performing a leak diagnosis, introduce a test pressure different from atmospheric pressure to said space by controlling any one of said air conducting valve, vapor passage valve and purge passage valve, including closing said air conducting valve, and begin said leak diagnosis of said space based on a pressure variation in said space after introducing said test pressure; and a second sensor for detecting if the filler cap has been removed, and an electrical circuit configured to forcibly open said air conducting valve if the filler cap has been removed and said leak diagnosis is being performed.

10. A leak diagnostic device as defined in claim 9, wherein said air conducting valve comprises a valve which closes due to electrical energization, said second sensor comprises a switch which switches ON when said filler cap is set on said filler tube, and switches OFF when said filler cap is removed from said filler tube, and said electrical circuit comprises a power transistor interposed in the current path from a power supply to said air conducting valve and a circuit connecting a base of said power transistor to said power supply via said switch.

11. A leak diagnostic device for use with a fuel vapor processor of an engine of a vehicle, said engine comprising a fuel tank and said processor comprising a canister for temporarily collecting fuel vapor in said fuel tank, a normally-open air conducting valve for connecting said canister to the atmosphere, a vapor passage connecting said fuel tank and said canister, a vapor passage valve for opening and closing said vapor passage, a purge passage connecting said canister and an engine intake passage, and a purge passage valve for opening and closing said purge passage, said device comprising:

means for detecting a pressure in a space comprising any one of the vapor passage, the canister, the purge passage and a fuel tank, means for introducing a test pressure different from atmospheric pressure to said space by controlling any one of said air conducting valve, vapor passage valve and purge passage valve, including closing said air conducting valve, means for beginning a leak diagnosis of said space based on a pressure variation in said space after introducing said test pressure, means for detecting if refueling of said fuel tank is being performed, and means for controlling said air conducting valve so that, if refueling of said fuel tank is being performed while said leak diagnosis is being performed, said canister is connected to the atmosphere.

* * * * *